US012672746B2

(12) United States Patent
Conrad

(10) Patent No.: US 12,672,746 B2
(45) Date of Patent: Jul. 7, 2026

(54) SURFACE CLEANING APPARATUS

(71) Applicant: Omachron Intellectual Property Inc., Hampton (CA)

(72) Inventor: Wayne Ernest Conrad, Hampton (CA)

(73) Assignee: Omachron Intellectual Property Inc., Hampton (CA)

( * ) Notice: Subject to any disclaimer, the term of this patent is extended or adjusted under 35 U.S.C. 154(b) by 0 days.

(21) Appl. No.: 18/109,931

(22) Filed: Feb. 15, 2023

(65) Prior Publication Data

US 2023/0190057 A1 Jun. 22, 2023

Related U.S. Application Data

(63) Continuation of application No. 16/431,822, filed on Jun. 5, 2019, now Pat. No. 11,612,290.

(51) Int. Cl.

| | |
|---|---|
| ***A47L 9/16*** | (2006.01) |
| ***A47L 5/24*** | (2006.01) |
| ***A47L 9/28*** | (2006.01) |
| ***A47L 9/32*** | (2006.01) |

(52) U.S. Cl.
CPC *A47L 9/16* (2013.01); *A47L 5/24* (2013.01); *A47L 9/2884* (2013.01); *A47L 9/322* (2013.01)

(58) Field of Classification Search
CPC ..... A47L 5/24; A47L 9/16; A47L 9/32; A47L 9/322; A47L 9/325; A47L 9/327; A47L 9/2884; A47L 11/4075
USPC ..... 15/329, 353, 344, 411, 410
See application file for complete search history.

(56) References Cited

U.S. PATENT DOCUMENTS

| | | | | |
|---|---|---|---|---|
| RE32,751 | E * | 9/1988 | Joss | A47L 5/24 15/352 |
| 5,267,371 | A | 12/1993 | Soler et al. | |
| 5,358,290 | A | 10/1994 | Fleet et al. | |
| 5,970,572 | A | 10/1999 | Thomas | |
| 5,974,625 | A | 11/1999 | Garner | |
| 6,098,244 | A | 8/2000 | Conrad et al. | |
| 6,099,661 | A | 8/2000 | Conrad | |
| 6,101,672 | A | 8/2000 | Conrad et al. | |
| 6,123,779 | A | 9/2000 | Conrad et al. | |
| 6,129,775 | A | 10/2000 | Conrad et al. | |
| 6,135,708 | A | 10/2000 | Conrad et al. | |
| 6,168,716 | B1 | 1/2001 | Conrad et al. | |
| 6,170,119 | B1 | 1/2001 | Conrad et al. | |

(Continued)

FOREIGN PATENT DOCUMENTS

| | | |
|---|---|---|
| AU | 2011211368 B2 | 9/2012 |
| CA | 2275675 A1 | 12/1999 |

(Continued)

OTHER PUBLICATIONS

KR 19990010268—Machine Translation (Year: 1999).*

(Continued)

*Primary Examiner* — Brian D Keller
*Assistant Examiner* — Alberto Saenz
(74) *Attorney, Agent, or Firm* — Philip C. Mendes da Costa; SMART & BIGGAR LP

(57) ABSTRACT

A hand vacuum cleaner has an air treatment member positioned in the air flow path downstream of a dirty air inlet. A motor and fan assembly produces an air flow through the air flow path. A handle is moveable between a first use position and a second use position.

20 Claims, 22 Drawing Sheets

(56) References Cited

U.S. PATENT DOCUMENTS 6,173,474 B1 1/2001 Conrad
6,174,127 B1 1/2001 Conrad et al.
6,183,641 B1 2/2001 Conrad et al.
6,224,325 B1 5/2001 Conrad et al.
6,231,645 B1 5/2001 Conrad et al.
6,238,177 B1 5/2001 Conrad et al.
6,243,917 B1 6/2001 Conrad
6,251,296 B1 6/2001 Conrad et al.
6,261,052 B1 7/2001 Conrad et al.
6,261,379 B1 7/2001 Conrad et al.
6,280,143 B1 8/2001 Parker et al.
6,307,358 B1 10/2001 Conrad
6,312,594 B1 11/2001 Conrad et al.
6,328,527 B1 12/2001 Conrad et al.
6,334,234 B1 1/2002 Conrad et al.
6,344,064 B1 2/2002 Conrad
6,440,197 B1 8/2002 Conrad et al.
6,457,205 B1 10/2002 Conrad
6,533,834 B2 3/2003 Conrad et al.
6,599,340 B2 7/2003 Conrad et al.
6,782,585 B1 8/2004 Conrad et al.
7,329,294 B2 2/2008 Conrad
7,740,675 B2 6/2010 Conrad
7,749,293 B2 7/2010 Conrad
7,776,120 B2 8/2010 Conrad
7,803,207 B2 9/2010 Conrad
7,811,345 B2 10/2010 Conrad
7,867,308 B2 1/2011 Conrad
7,941,895 B2 5/2011 Conrad
8,127,398 B2 3/2012 Conrad
8,146,201 B2 4/2012 Conrad
8,151,407 B2 4/2012 Conrad
8,176,596 B2 5/2012 Conrad
8,192,515 B2 6/2012 Conrad
8,292,979 B2 10/2012 Conrad
8,296,900 B2 10/2012 Conrad
8,349,428 B2 1/2013 Conrad
8,370,993 B2 2/2013 Conrad
8,375,508 B2 2/2013 Conrad
8,448,291 B2 5/2013 Conrad
8,479,358 B2 7/2013 Conrad
8,484,799 B2 7/2013 Conrad
8,486,170 B2 7/2013 Conrad et al.
8,510,907 B2 8/2013 Conrad
8,533,904 B2 9/2013 Conrad
8,561,257 B2 10/2013 Conrad
8,567,005 B2 10/2013 Conrad
8,578,550 B2 11/2013 Conrad
8,578,553 B2 11/2013 Conrad
8,590,102 B2 11/2013 Conrad
8,607,407 B2 12/2013 Conrad
8,621,709 B2 1/2014 Conrad
8,632,923 B2 1/2014 Sohn
8,640,304 B2 2/2014 Conrad
8,646,147 B2 2/2014 Conrad
8,659,184 B2 2/2014 Conrad
8,677,554 B2 3/2014 Conrad
8,677,558 B2 3/2014 Conrad
8,713,751 B2 5/2014 Conrad
8,813,305 B2 8/2014 Conrad
8,834,209 B2 9/2014 Conrad
8,869,344 B2 10/2014 Conrad
8,869,345 B2 10/2014 Conrad
8,869,348 B2 10/2014 Conrad
8,875,340 B2 11/2014 Conrad
8,875,342 B2 11/2014 Conrad
9,027,198 B2 5/2015 Conrad
9,027,203 B2 5/2015 Conrad et al.
9,066,642 B2 6/2015 Conrad
9,119,513 B2 9/2015 Conrad
9,161,666 B2 10/2015 Conrad
9,161,669 B2 10/2015 Conrad
9,167,944 B2 10/2015 Conrad
9,204,769 B2 12/2015 Conrad
9,204,773 B2 12/2015 Conrad
9,215,960 B2 12/2015 Conrad
9,226,633 B2 1/2016 Conrad et al.
9,227,151 B2 1/2016 Conrad
9,227,201 B2 1/2016 Conrad
9,232,881 B2 1/2016 Conrad
9,238,235 B2 1/2016 Conrad
9,295,995 B2 3/2016 Conrad
9,314,138 B2 4/2016 Conrad
9,314,139 B2 4/2016 Conrad et al.
9,320,401 B2 4/2016 Conrad
9,326,652 B2 5/2016 Conrad
9,364,127 B2 6/2016 Conrad
9,427,122 B2 8/2016 Conrad et al.
9,427,126 B2 8/2016 Conrad
9,433,332 B2 9/2016 Conrad
9,451,852 B2 9/2016 Conrad
9,451,855 B2 9/2016 Conrad
9,456,721 B2 10/2016 Conrad
9,492,045 B2 11/2016 Conrad
9,526,394 B2 12/2016 Conrad
9,572,463 B2 2/2017 Conrad
9,591,952 B2 3/2017 Conrad
9,591,958 B2 3/2017 Conrad
9,775,484 B2 10/2017 Conrad
9,801,513 B2 10/2017 Conrad et al.
9,820,621 B2 11/2017 Conrad et al.
9,962,047 B2 5/2018 Brown et al.
10,076,183 B2 9/2018 Conrad et al.
10,149,587 B2 12/2018 Conrad et al.
10,159,393 B2 12/2018 Conrad
10,201,259 B2 * 2/2019 Wang ..... A47L 5/14
10,201,260 B2 2/2019 Conrad et al.
10,214,349 B2 2/2019 Conrad
10,251,519 B2 4/2019 Conrad
10,357,136 B2 7/2019 Conrad
10,537,216 B2 1/2020 Conrad
10,537,219 B2 1/2020 Conrad et al.
10,568,477 B2 2/2020 Conrad
10,575,693 B2 3/2020 Conrad
10,667,663 B2 6/2020 Conrad
10,687,679 B2 6/2020 Conrad et al.
10,729,294 B2 8/2020 Conrad et al.
10,791,890 B2 10/2020 Conrad
10,791,896 B2 10/2020 Conrad
10,888,205 B2 1/2021 Conrad et al.
10,932,634 B2 3/2021 Conrad
10,959,588 B2 3/2021 Conrad et al.
11,013,378 B2 5/2021 Conrad
11,108,254 B2 8/2021 Conrad
11,135,602 B2 10/2021 Conrad
11,154,169 B2 10/2021 Conrad
11,198,085 B2 12/2021 Conrad et al.
11,213,179 B2 1/2022 Conrad
11,285,495 B2 3/2022 Conrad
11,318,482 B2 5/2022 Conrad
11,330,949 B2 5/2022 Brown et al.
11,478,116 B2 10/2022 Conrad
11,478,117 B2 10/2022 Conrad et al.
11,534,041 B2 12/2022 Conrad
11,534,043 B2 12/2022 Conrad
11,571,097 B2 2/2023 Conrad
11,793,374 B2 10/2023 Conrad
11,857,142 B2 1/2024 Conrad
11,950,745 B2 4/2024 Conrad et al.
2001/0027587 A1 10/2001 Conrad et al.
2002/0162188 A1 11/2002 Harmen
2003/0201754 A1 10/2003 Conrad
2004/0216266 A1 11/2004 Conrad
2006/0196004 A1 9/2006 Conrad
2006/0288516 A1 12/2006 Sawalski
2007/0033765 A1 2/2007 Walker et al.
2008/0172992 A1 7/2008 Conrad
2008/0178416 A1 7/2008 Conrad
2008/0178418 A1 7/2008 Conrad
2008/0179133 A1 7/2008 Conrad
2008/0196366 A1 8/2008 Conrad
2008/0216281 A1 9/2008 Conrad
2010/0175217 A1 7/2010 Conrad
2010/0229323 A1 9/2010 Conrad

(56) References Cited

U.S. PATENT DOCUMENTS

| | | | | |
|---|---|---|---|---|
| 2010/0229325 | A1 | 9/2010 | Conrad | |
| 2010/0229326 | A1 | 9/2010 | Conrad | |
| 2010/0229334 | A1 | 9/2010 | Conrad | |
| 2010/0229335 | A1 | 9/2010 | Conrad | |
| 2010/0251507 | A1 | 10/2010 | Conrad | |
| 2011/0219567 | A1 | 9/2011 | Conrad | |
| 2011/0219579 | A1 | 9/2011 | Conrad | |
| 2012/0222245 | A1 | 9/2012 | Conrad | |
| 2012/0304417 | A1 | 12/2012 | Riley | |
| 2013/0091654 | A1 | 4/2013 | Smith | |
| 2013/0091656 | A1 | 4/2013 | Smith | |
| 2013/0091657 | A1 | 4/2013 | Smith | |
| 2013/0091810 | A1 | 4/2013 | Smith | |
| 2013/0091812 | A1 | 4/2013 | Smith | |
| 2013/0091813 | A1 | 4/2013 | Smith | |
| 2014/0237768 | A1 | 8/2014 | Conrad | |
| 2017/0303754 | A1* | 10/2017 | Conrad | A47L 5/24 |
| 2019/0343356 | A1 | 11/2019 | Kim et al. | |
| 2020/0305671 | A1 | 10/2020 | Conrad | |
| 2021/0228032 | A1 | 7/2021 | Conrad | |
| 2022/0142440 | A1 | 5/2022 | Conrad | |
| 2022/0151446 | A1 | 5/2022 | Conrad et al. | |
| 2023/0263350 | A1 | 8/2023 | Conrad et al. | |
| 2023/0348169 | A1 | 11/2023 | Conrad | |
| 2024/0016351 | A1 | 1/2024 | Conrad | |
| 2024/0138634 | A1 | 5/2024 | Conrad | |
| 2024/0180373 | A1 | 6/2024 | Conrad et al. | |
| 2024/0358212 | A1 | 10/2024 | Conrad | |

FOREIGN PATENT DOCUMENTS

| | | | | | |
|---|---|---|---|---|---|
| CA | 2258416 | A1 | | 7/2000 | |
| CA | 2258419 | A1 | | 7/2000 | |
| CA | 2258421 | A1 | | 7/2000 | |
| CA | 2258422 | A1 | | 7/2000 | |
| CA | 2258423 | A1 | | 7/2000 | |
| CA | 2258426 | A1 | | 7/2000 | |
| CA | 2330801 | A1 | | 7/2001 | |
| CA | 2288544 | A1 | | 5/2002 | |
| CA | 2338193 | A1 | | 7/2002 | |
| CA | 2339514 | A1 | | 9/2002 | |
| CA | 2342673 | A1 | | 9/2002 | |
| CA | 2342993 | A1 | | 9/2002 | |
| CA | 2658014 | A1 | | 9/2010 | |
| CA | 2658022 | A1 | | 9/2010 | |
| CA | 2658160 | A1 | | 9/2010 | |
| CA | 2658366 | A1 | | 9/2010 | |
| CA | 2658397 | A1 | | 9/2010 | |
| CA | 2658497 | A1 | | 9/2010 | |
| CA | 2658643 | A1 | | 9/2010 | |
| CA | 2658644 | A1 | | 9/2010 | |
| CA | 2484587 | C | | 1/2011 | |
| CA | 2731525 | C | | 1/2014 | |
| CN | 101108106 | B | | 7/2012 | |
| CN | 101897558 | B | | 9/2014 | |
| CN | 102256523 | B | | 11/2014 | |
| CN | 105816104 | A | * | 8/2016 | A47L 9/02 |
| CN | 107397508 | A | * | 11/2017 | |
| CN | 108567374 | A | | 9/2018 | |
| CN | 109330478 | A | * | 2/2019 | |
| DE | 60116336 | T2 | | 8/2006 | |
| KR | 19990010268 | A | * | 2/1999 | |
| WO | 0010718 | A1 | | 3/2000 | |

OTHER PUBLICATIONS

CN109330478—Machine Translation (Year: 2019).*
CN107397508—Machine Translation (Year: 2017).*
CN 105816104—Machine Translation (Year: 2016).*
Author: Cambridge Dictionaries Online Date: Sep. 10, 2015 URL: https://web.archive.org/web/20150910003703/https://dictionary.cambridge.org/us/dictionary/english/axis (Year: 2015).*
English machine translation of CN102256523, published on Nov. 5, 2014.
English machine translation of CN101897558, published on Sep. 17, 2014.
English machine translation of CN101108106, published on Jul. 18, 2012.
English machine translation of DE60116336T2, published on Aug. 31, 2006.
English machine translation of CN108567374A, published on Sep. 25, 2018.
U.S. Appl. No. 09/343,479, filed Jun. 30, 1999.

* cited by examiner

SURFACE CLEANING APPARATUS

CROSS-REFERENCE TO RELATED APPLICATIONS

This application is a continuation of co-pending U.S. patent application Ser. No. 16/431,822, filed on Jun. 5, 2019, the entirety of which is hereby incorporated by reference.

FIELD

The specification relates to surface cleaning apparatus. In a preferred embodiment, the surface cleaning apparatus comprises a portable surface cleaning apparatus, such as a hand vacuum cleaner.

INTRODUCTION

Various types of surface cleaning apparatus are known, including upright surface cleaning apparatus, canister surface cleaning apparatus, stick surface cleaning apparatus, hand carriable surface cleaning apparatus, and central vacuum systems.

While some surface cleaning apparatus are powered by external sources, others are powered by on board energy storage members. Many on board energy storage members produce heat when discharging, particularly when discharging at a high rate such as when a user increases the power consumption of a power consuming member.

SUMMARY

The following introduction is provided to introduce the reader to the more detailed discussion to follow. The introduction is not intended to limit or define any claimed or as yet unclaimed invention. One or more inventions may reside in any combination or sub-combination of the elements or process steps disclosed in any part of this document including its claims and figures.

In accordance with an aspect of this disclosure, a surface cleaning apparatus has on board energy storage. The on board energy storage may be provided by one or more energy storage members such as a battery or a capacitor (e.g., a super capacitor). The energy storage member(s) may be provided in a housing (e.g. an energy storage module such as a battery pack) which may be removably mounted to the surface cleaning apparatus. During operation of the surface cleaning apparatus, the on board energy storage members can produce heat. In accordance with this aspect, the energy storage member(s) are in thermal communication with the air flow passage through the surface cleaning apparatus. The energy storage members may, e.g., abut or form part of the air flow path and thereby be cooled by the flow of air through the surface cleaning apparatus.

Typically, during operation, a suction motor produces heat that may need to be dissipated. While the air downstream of a suction motor may have been treated to remove particulate matter and may therefore be useable to cool an energy storage module without contaminating the energy storage module with dirt, the air has been heated by the suction motor and therefore its efficacy to cool an energy storage module is at least limited. In accordance with this aspect, the energy storage member(s) can be in thermal communication with the air flow passage through the surface cleaning apparatus at a location upstream of the suction motor and downstream from at least one, and optionally two or more, air treatment members (such as a momentum separator, a cyclonic cleaning stage, a pre-motor filter or a combination of two or more of these air treatment members).

As hand vacuum cleaner is a surface cleaning apparatus that is typically supported by a user using only one hand, the size and weight distribution of the components within the hand vacuum cleaner can have a large impact on the maneuverability and usability of the hand vacuum cleaner. In accordance with this aspect, the hand vacuum cleaner can be arranged with operative components (e.g. suction motor, on-board energy storage member(s), air treatment member (s), and/or filters) in a generally linear configuration. This may provide the hand vacuum cleaner with a more even distribution of weight, which may facilitate one-handed maneuvering of the hand vacuum cleaner.

In accordance with this aspect, there is provided a hand vacuum cleaner having a front end, a front end, a rear end, an upper end and a lower end, the hand vacuum cleaner comprising:

(a) an air flow path extending from a dirty air inlet to a clean air outlet;

(b) an air treatment member chamber positioned in the air flow path downstream of the dirty air inlet, the air treatment member chamber having a longitudinal axis extending between a front end of the air treatment member chamber and a rear end of the air treatment member chamber;

(c) an on board energy storage member positioned in the air flow path downstream from the air treatment member chamber whereby air passing through the air flow path cools the on board energy storage member; and, (d) a suction motor positioned in the air flow path downstream of the on board energy storage member and upstream of the clean air outlet.

In some embodiments, the air treatment member chamber may comprise a cyclone chamber.

In some embodiments, the cyclone chamber may have a cyclone inlet at a front end of the cyclone chamber and an air outlet at a rear end of the cyclone chamber.

In some embodiments, the on board energy storage member may be positioned in an energy storage member housing, the suction motor may be positioned in a suction motor housing and the longitudinal axis may extend through the air treatment member chamber, the energy storage member housing and the suction motor housing.

In some embodiments, the hand vacuum cleaner may further comprise a pre-motor filter positioned in the air flow path downstream from the air treatment member chamber and upstream from the on board energy storage member.

In some embodiments, the on board energy storage member may be positioned in an energy storage member housing, the suction motor may be positioned in a suction motor housing and the longitudinal axis may extend through the air treatment member chamber, the energy storage member housing, a pre-motor filter volume defined by a perimeter of the pre-motor filter and the suction motor housing.

In some embodiments, the pre-motor filter maybe at least partially nested in the air treatment member chamber.

In some embodiments, the hand vacuum cleaner may further comprise a cyclonic cleaning stage positioned in the air flow path downstream from the air treatment member chamber and upstream from the pre-motor filter, and the longitudinal axis may extend through a cyclonic cleaning stage volume defined by a perimeter of the cyclonic cleaning stage.

In some embodiments, the pre-motor filter may be at least partially nested in the cyclonic cleaning stage.

In some embodiments, the air treatment member chamber may comprise a first stage cyclone chamber and the air outlet of the air treatment member chamber may comprise a rigid porous member having a plurality of openings positioned in the first stage cyclone chamber and the pre-motor filter may be at least partially nested in the rigid porous member.

In some embodiments, the suction motor may be provided in a main body and the hand vacuum cleaner may further comprise a handle moveably mounted between a first position and a second position in which the handle extends rearwardly of the main body.

In some embodiments, the handle may be moveably mounted to a rear face of the main body.

In some embodiments, when the longitudinal axis extends horizontally, the upper end may be located above the lower end and the handle maybe in the first position, a portion of the handle may be located below the lower end of the hand vacuum cleaner.

In some embodiments, the hand vacuum cleaner may further comprise a post-motor filter positioned in the air flow path downstream of the suction motor and upstream of the clean air outlet, the post motor filter may have an open interior and at least a portion of the suction motor may be located in the open interior.

In some embodiments, the hand vacuum cleaner may further comprise a pre-motor filter and a post-motor filter, the pre-motor filter may be positioned in the air flow path downstream from the air treatment member chamber and upstream from the on board energy storage member and the pre-motor filter may be at least partially nested in the cyclonic cleaning stage, and the post-motor filter may be positioned in the air flow path downstream of the suction motor and upstream of the clean air outlet, the post motor filter may have an open interior and at least a portion of the suction motor may be located in the open interior.

In some embodiments, the on board energy storage member may be positioned in an energy storage member housing, the suction motor may be positioned in a suction motor housing and the longitudinal axis may extend through the air treatment member chamber, the energy storage member housing, a pre-motor filter volume defined by a perimeter of the pre-motor filter and the suction motor housing.

In accordance with an aspect of this disclosure, a surface cleaning apparatus has a uniflow cyclone unit with a rigid porous member (e.g., a screen or shroud that may be at least partially positioned in the cyclone chamber). A uniflow cyclone is a cyclone with an air inlet at a first end and an outlet at a second axially opposed end. A pre-motor filter may be nested, at least partially, within the rigid porous member. This can reduce the overall length of the surface cleaning apparatus.

In accordance with this aspect, there is provided a surface cleaning apparatus comprising (a) an air flow path extending from a dirty air inlet to a clean air outlet;

(b) a uniflow cyclone chamber positioned in the air flow path downstream of the dirty air inlet, the uniflow cyclone chamber has a longitudinal axis extending between a first end of the uniflow cyclone chamber and a second end of the uniflow cyclone chamber, an air inlet at the first end and an air outlet at the second end, the air outlet comprising a rigid porous member having a plurality of openings positioned in the uniflow cyclone chamber;

(c) a pre-motor filter at least partially nested in the rigid porous member; and, (d) a suction motor positioned in the air flow path downstream of the uniflow cyclone chamber and upstream of the clean air outlet.

In some embodiments, the hand vacuum cleaner may further comprise an on board energy storage member positioned in the air flow path downstream from the pre-motor filter and upstream of the suction motor, whereby air passing through the air flow path cools the on board energy storage member.

In some embodiments, a surface cleaning apparatus may be provided that includes:

(a) a surface cleaning head having a dirty air inlet; and, (b) an upper section moveably mounted to the surface cleaning head between an upright storage position and a rearwardly inclined in use position, the upper section having a recess removably receiving a hand vacuum cleaner as disclosed here.

In some embodiments, the upper section may further comprise an accessory tool holding member wherein the accessory tool is removably connectable with an inlet of the hand vacuum cleaner when the hand vacuum cleaner and the accessory tool are removed from the upper section.

It will be appreciated that the aspects and embodiments may be used in any combination or sub-combination.

A BRIEF DESCRIPTION OF THE DRAWINGS

The drawings included herewith are for illustrating various examples of articles, methods, and apparatuses of the teaching of the present specification and are not intended to limit the scope of what is taught in any way.

DESCRIPTION OF VARIOUS EMBODIMENTS

Figure 1:
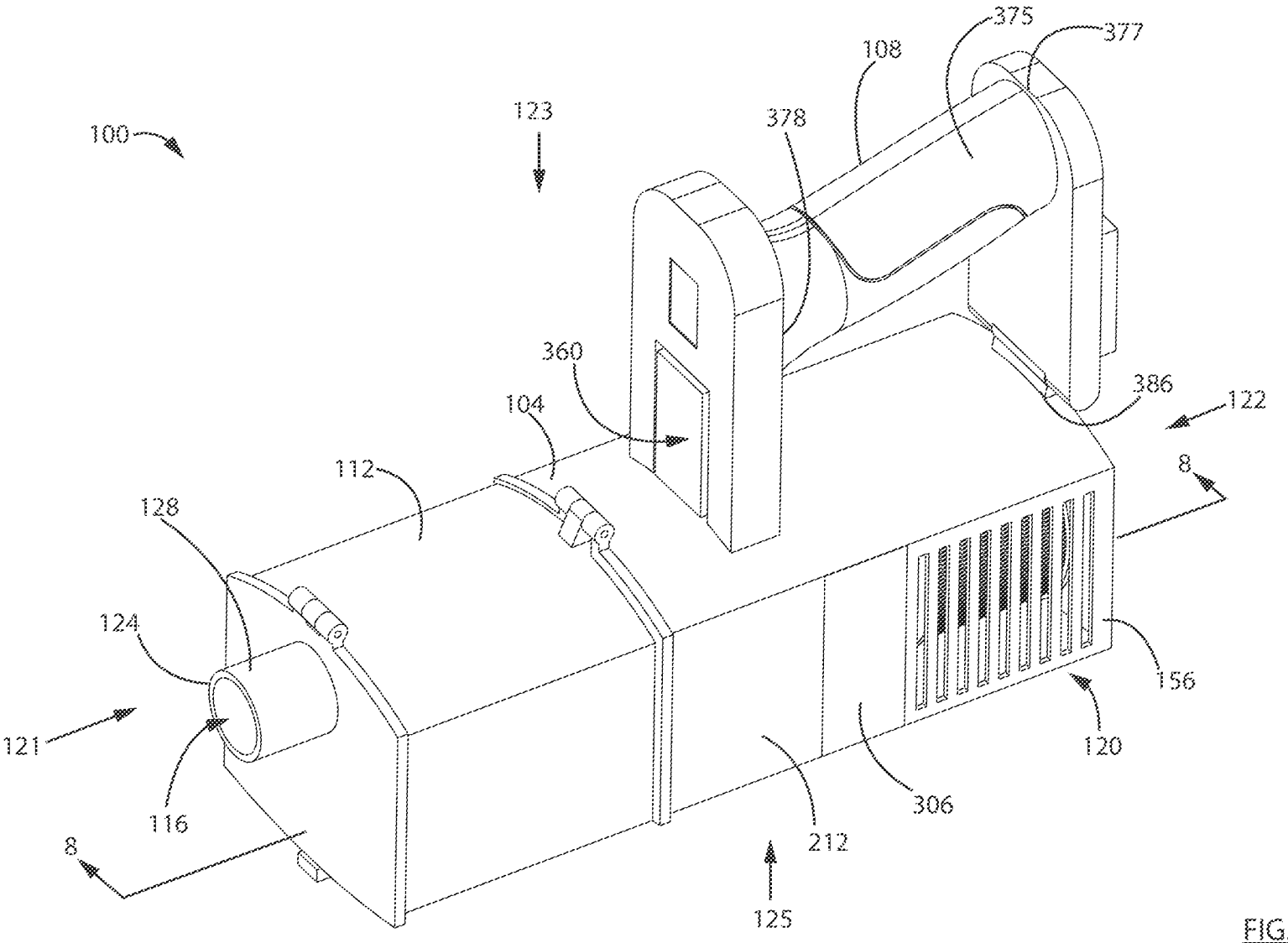
FIG. 1 is a top front perspective view of an example surface cleaning apparatus in accordance with at least one embodiment.

Numerous embodiments are described in this application, and are presented for illustrative purposes only. The described embodiments are not intended to be limiting in any sense. The invention is widely applicable to numerous embodiments, as is readily apparent from the disclosure herein. Those skilled in the art will recognize that the present invention may be practiced with modification and alteration without departing from the teachings disclosed herein. Although particular features of the present invention may be described with reference to one or more particular embodiments or figures, it should be understood that such features are not limited to usage in the one or more particular embodiments or figures with reference to which they are described.

The terms "an embodiment," "embodiment," "embodiments," "the embodiment," "the embodiments," "one or more embodiments," "some embodiments," and "one embodiment" mean "one or more (but not all) embodiments of the present invention(s)," unless expressly specified otherwise.

The terms "including," "comprising" and variations thereof mean "including but not limited to," unless expressly specified otherwise. A listing of items does not imply that any or all of the items are mutually exclusive, unless expressly specified otherwise. The terms "a," "an" and "the" mean "one or more," unless expressly specified otherwise.

As used herein and in the claims, two or more parts are said to be "coupled", "connected", "attached", or "fastened" where the parts are joined or operate together either directly or indirectly (i.e., through one or more intermediate parts), so long as a link occurs. As used herein and in the claims, two or more parts are said to be "directly coupled", "directly connected", "directly attached", or "directly fastened" where the parts are connected in physical contact with each other. As used herein, two or more parts are said to be "rigidly coupled", "rigidly connected", "rigidly attached", or "rigidly fastened" where the parts are coupled so as to move as one while maintaining a constant orientation relative to each other. None of the terms "coupled", "connected", "attached", and "fastened" distinguish the manner in which two or more parts are joined together.

Referring to FIGS. 1-9, an example embodiment of a surface cleaning apparatus 100 is shown. In the example illustrated, the surface cleaning apparatus 100 is a hand-held vacuum cleaner, which is commonly referred to as a "hand vacuum cleaner" or a "handvac". As used herein and in the claims, a hand-held vacuum cleaner or hand vacuum cleaner or handvac is a vacuum cleaner that can be operated one-handedly to clean a surface while its weight is held by the same one hand. This is contrasted with upright and canister vacuum cleaners, the weight of which is supported by a surface (e.g. floor below) during use. Optionally, surface cleaning apparatus 100 could be removably mountable on a base so as to form, for example, an upright vacuum cleaner, a canister vacuum cleaner, a stick vac, a wet-dry vacuum cleaner and the like. Optionally, surface cleaning apparatus 100 could be an upright vacuum cleaner, a canister vacuum cleaner, a stick vac, a wet-dry vacuum cleaner and the like.

As exemplified, the surface cleaning apparatus 100 may comprise a main body 104 having a handle 108, an air treatment member 112 connected to the main body 104, a dirty air inlet 116, a clean air outlet 120, and an air flow path extending between the inlet 116 and outlet 120. Surface cleaning apparatus 100 includes a front end 121, a rear end 122, an upper end 123, and a bottom 125. In the embodiment shown, the dirty air inlet 116 is at the front end 121. As exemplified, dirty air inlet 116 is the inlet end 124 of an inlet passage 128. Dirty air inlet 116 may be positioned forward of air treatment member 112 as shown. Optionally, the inlet conduit 128 can be used as a nozzle to directly clean a surface. Alternatively, or in addition to functioning as a nozzle, the inlet end 124 can be connected or directly connected to the downstream end of any suitable accessory tool such as a rigid air flow conduit (e.g. wand, crevice tool, mini brush or the like) for example.

From the dirty air inlet 116, the air flow path may extend through an air treatment member 112. The air treatment member 112 may be any suitable member or members that can treat the air in a desired manner, including, for example, removing dirt particles and debris from the air. For example, one or more cyclones, filters, momentum separators and/or bags may be provided. As exemplified, at least one air treatment member, and optionally two or more are provided upstream of the suction motor and fan assembly to clean the dirty air before the air passes through the suction motor.

As exemplified, the air inlet conduit 128 may be a generally linear hollow member that extends axially in the direction of an inlet conduit axis 364 that may be oriented in a longitudinal forward/backward direction and is generally horizontal when hand vacuum cleaner 100 is oriented with the upper end 123 above the lower end 125. As exemplified, dirty air inlet 116 is positioned forward of the air treatment member 112, although this need not be the case.

As exemplified, the air treatment member is a cyclone unit 112. Cyclone unit 112 may include one or a plurality of cyclones for separating dirt from the air flow, and one or a plurality of dirt collection regions for receiving dirt separated in the cyclone(s). In other embodiments, the cyclone unit may comprise a plurality of cyclones in parallel. Alternately, or in addition, two or more cyclone units may be provided, each of which may comprise a single cyclone or a plurality of cyclones in parallel.

Figure 8:
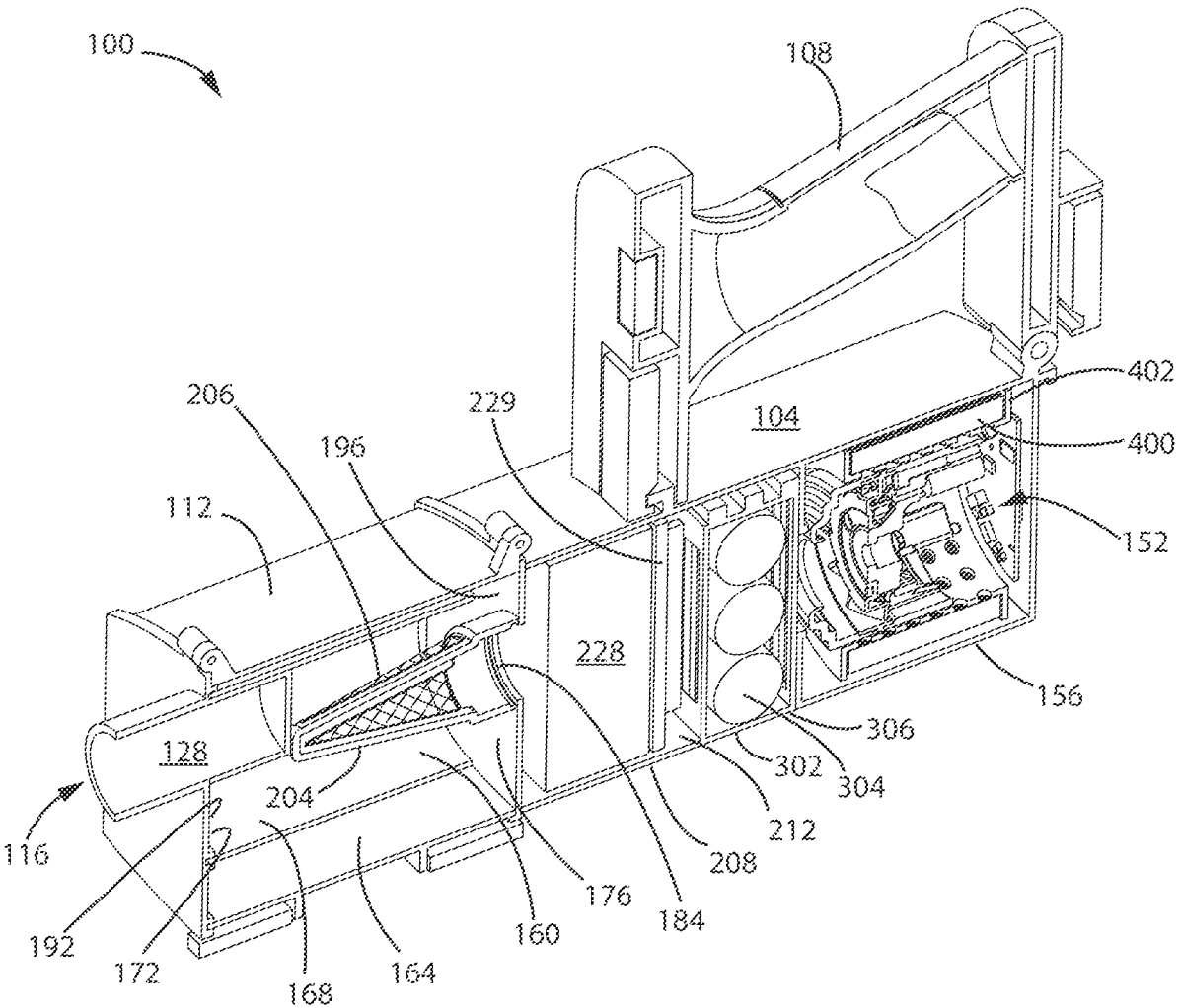
FIG. 8 is a perspective sectional view of the surface cleaning apparatus of FIG. 1 taken alone line 8-8 in FIG. 1.
Figure 9:
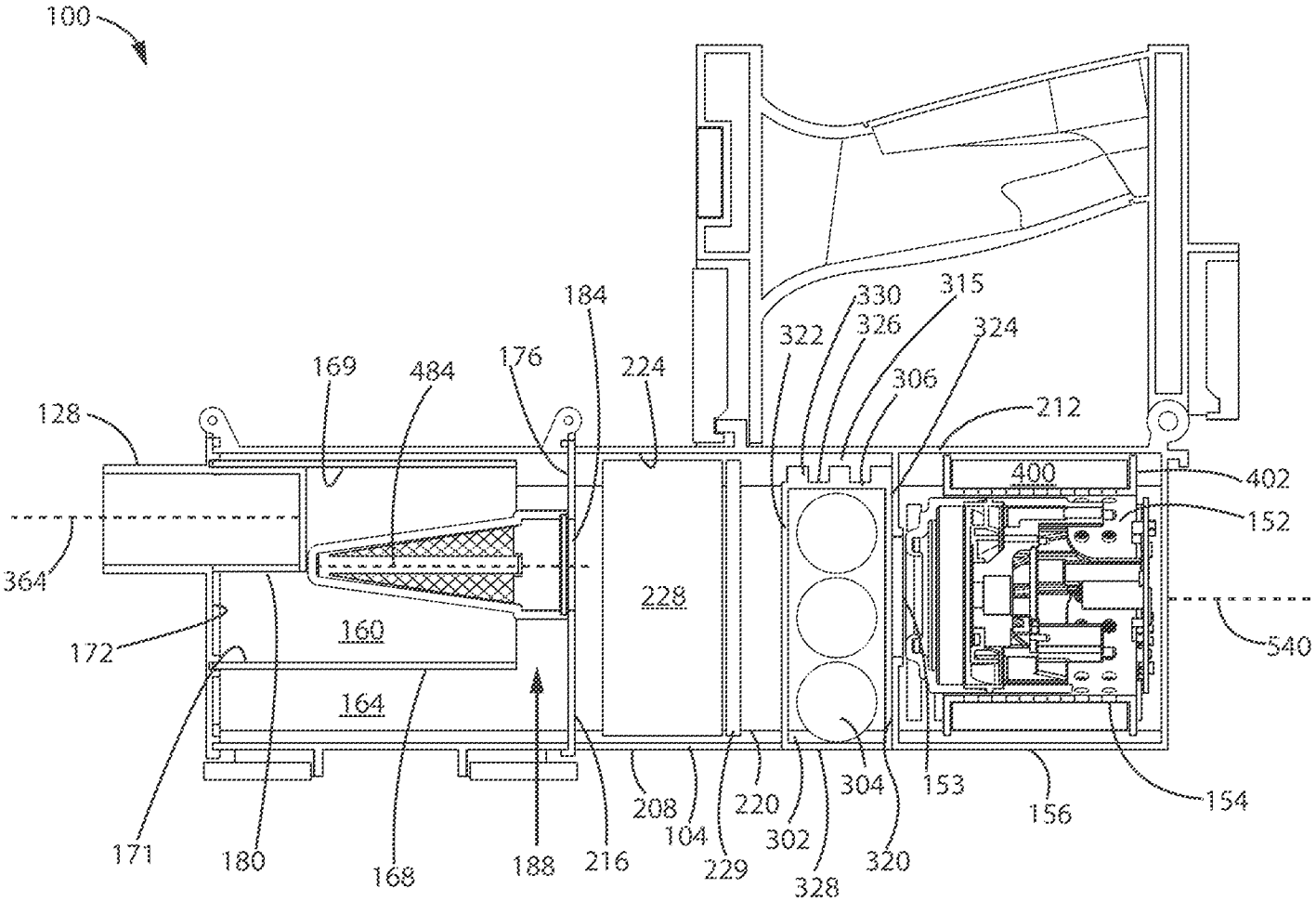
FIG. 9 is a sectional view of the surface cleaning apparatus of FIG. 1 taken alone line 8-8 in FIG. 1.

As exemplified in FIGS. 8 and 9, cyclone unit 112 includes a single cyclone chamber 160 and an external dirt collection chamber 164. The cyclone 160 and dirt collection chamber 164 may be of any configuration suitable for separating dirt from an air stream and collecting the separated dirt, respectively.

Optionally, the air treatment member 112 may be openable and/or removable to allow cyclone chamber 160 and/or external dirt collection chamber 164 to be emptied and/or cleaned.

It will be appreciated that the dirt collection region may be located inside the cyclone chamber 160, e.g., at an openable end of the cyclone chamber 160. Alternatively or in addition, in some embodiments the cyclone unit 112 may include a dirt collection area 164 exterior to the cyclone chamber 160 as shown in FIG. 8 for example.

The cyclone chamber 160 can include an axis of rotation 484 that extends longitudinally (axially) from a front end 172 of cyclone chamber 160 to a rear end 176 of the cyclone chamber 160 (see e.g. FIG. 9). Cyclone chamber 160 may be oriented in any direction. For example, when surface cleaning apparatus 100 is positioned with bottom 125 on a horizontal surface, cyclone axis of rotation 484 may be oriented generally horizontally as exemplified, generally vertically, or at any angle between horizontal and vertical.

As exemplified in FIGS. 8 and 9, cyclone chamber 160 comprises a cyclone sidewall 168 that may extend axially from a cyclone first end 172 (e.g. front end comprising first end wall 192) to a cyclone second end 176 (e.g. rear end comprising second end wall 196).

As exemplified in FIGS. 8 and 9, the cyclone chamber 160 can be configured with a unidirectional flow of air. Such a configuration may be referred to as a "uniflow" cyclone. As exemplified, in the uniflow cyclone chamber 160, the cyclone air inlet 180 may be towards or at the front end 172 of the cyclone chamber 160 and the cyclone air outlet 184 may be at or towards the rear end 176 of the cyclone chamber 160. An advantage of this design is that the cyclone inlet 180 may be aligned with the cyclone chamber (e.g., the inlet conduit axis 364 may extend through the cyclone chamber).

In accordance with a uniflow cyclone design, cyclone air inlet 180, which may be a tangential air inlet, may be provided at the rear end of inlet passage 128. As such, the tangential air inlet may be located within the cyclone chamber 160. With this design, enters cyclone chamber 160 at a front portion of sidewall 168.

Also in accordance with a uniflow cyclone design, a cyclone air outlet 184 is provided in cyclone second end wall 196. Accordingly, the air may exit the cyclone chamber 160 and travel linearly towards the suction motor 152.

In the example illustrated, air entering the dirty air inlet 116 passes through the air inlet conduit 128 and enters the cyclone chamber 160 via cyclone air inlet 180. As exemplified in FIG. 9, dirty air may enter cyclone 160 tangentially at cyclone air inlet 180, and swirl (e.g. move cyclonically) through cyclone 160 to separate dirt from the air flow, and then exit cyclone 160 through cyclone air outlet 184. The separated dirt may be collected within an internal dirt collection area and/or a dirt collection chamber 164 exterior to the cyclone 160. If an external dirt collection chamber is provided, then the cyclone chamber 160 has a cyclone dirt outlet 188.

Alternately, the cyclone air inlet 180 may be positioned elsewhere in any suitable configuration, such as other locations in the cyclone chamber sidewall 168 and/or front end wall 192. For example, it will be appreciated that the inlet passage 128 may be positioned above the cyclone chamber 160.

As exemplified, a porous member 204, such as a screen member, shroud or vortex finder, may overlie the outlet of the cyclone (cyclone air outlet 184) and extend axially from the second end 176 towards, or to, the cyclone first end 172. Vortex finder 204 may have any configuration known in the art. For example, vortex finder 204 may be connected to cyclone second end wall 196 and may be tapered towards cyclone first end 172 as exemplified.

Vortex finder 204 may surround cyclone air outlet 184, so that air exiting cyclone chamber 160 travels downstream (rearwardly) through vortex finder 204 to cyclone air outlet 184. In some embodiments, the vortex finder 204 may define or enclose an air outlet conduit of the cyclone chamber 160.

The vortex finder 204 may be any porous member that permits air to exit from the cyclone chamber 160 and then travel rearwardly to exit via the cyclone air outlet 184. The porous member may include a plurality of openings to permit air to pass therethrough. The openings may be sized to reduce or prevent dirt and/or debris from exiting through cyclone outlet 184. Vortex finder 204 may include filter media 206 (e.g. a mesh, a screen or a plastic housing with a plurality of opening therethrough) to capture large dirt particles (e.g. hair and coarse dust) that remains in the air flow exiting cyclone 160. The size of the opening may be determined based on the size of dirt particles that may be permitted to exit the cyclone chamber 160.

As also exemplified in FIGS. 8 and 9, a suction motor and fan assembly 152 may be mounted within a motor housing portion 156 of the main body 104. In this configuration, the suction motor and fan assembly 152 is downstream from the cyclone unit 112, and the clean air outlet 120 is downstream from the suction motor and fan assembly 152.

The suction motor and fan assembly 152 may be oriented in any direction. For example, when surface cleaning apparatus 100 is positioned with bottom 125 on a horizontal surface, suction motor axis of rotation 540 may be oriented generally horizontally as exemplified, generally vertically, or at any angle between horizontal and vertical.

As exemplified in FIG. 9, in some embodiments the axis of rotation 540 of the suction motor may be generally parallel to and optionally co-axial with the cyclone axis of rotation 484 and/or the inlet conduit axis 364. An advantage of this design is that the air may travel generally rearwardly from the cyclone air outlet 184 to the suction motor air inlet, thereby reducing the backpressure through this portion of the vacuum cleaner 100 due to a reduction in the number of bends in the air flow path. Accordingly, may travel in a generally uniform, and linear, direction through the components of the handvac 100.

As exemplified in FIG. 9, handvac inlet nozzle 128 may extend in length from an upstream nozzle end 124 rearwardly along the nozzle axis 364, handvac cyclone chamber 160 may extend from a front end 172 (where cyclone air inlet 180 is located) along a cyclone axis 484 to a rear end 176 (where cyclone air outlet 184 is located), and handvac suction motor 152 may extend rearwardly from a motor inlet 153 along a motor axis 540. In some embodiments, two or more of nozzle axis 364, cyclone axis 484, and motor axis 540 may be parallel and, optionally, may be co-axial. In other embodiments, nozzle axis 364, cyclone axis 484, and motor axis 540 may all be co-axial.

In the example illustrated, motor outlet 154 may be positioned to direct air out towards the lateral sides of the main body 104. This may allow the handle to pivot to a position extending rearwardly from the main body 104 without interfering with air exiting the hand vacuum cleaner (see e.g. FIGS. 5-7 and 17-20).

Alternately, the motor outlet 154 (and clean air outlet 120) may be positioned in the rear face 222 of the main body 104. This may promote a linear air flow through the rear portion of the hand vacuum cleaner 100.

Power can be supplied to the surface cleaning apparatus 100 by an electrical cord (not shown) that can be connected to a standard wall electrical outlet. Alternatively, or in addition, the power source for the surface cleaning apparatus can be an onboard energy storage module 302, comprising, for example, one or more energy storage members 304 as in the example illustrated. Each energy storage member may be, for example, a battery or a capacitor, such as a super capacitor.

An energy storage module may include one or more energy storage members and the energy storage members may be provided in a housing, which housing may be removably mounted in the surface cleaning apparatus 100. If more than one energy storage member is included in an energy storage module, the plurality of energy storage members may be of a common size or of diverse sizes, shapes, and types. For example, an energy storage module may comprise a small flat battery and a large arcuate super capacitor. The energy storage members may be provided in a housing and may be referred to collectively as an energy storage module or energy storage member pack. For example, if the energy storage members are batteries, then the energy storage member pack may be referred to as a battery pack.

Various possible shapes or configurations may be used for a single energy storage member, or an energy storage module. In the example of FIGS. 8 and 9, energy storage module 302 is a flat, rigid device, however an energy storage module may also take on other shapes and rigidities. For example, energy storage module may be arcuate in shape, annular in shape, or partially annular in shape. It will be appreciated that an energy storage module may have any such shape.

FIGS. 8 and 9 exemplify a generally rectangular energy storage module 302 positioned in the air flow path through surface cleaning apparatus 100. As exemplified, energy storage module 302 contains a set of three energy storage members 304 (e.g., cylindrical batteries) contained in a cover or outer housing 320. As exemplified, energy storage members 304 are each cylindrical batteries having a common size. The cylindrical batteries have a longitudinal axis that, as exemplified, is in a plane that is transverse to the cyclone and inlet conduit axes.

As exemplified, the energy storage member housing 320 may be positioned within an energy storage member portion or housing 306 of the main body 104. Energy storage member portion 306 may be positioned between a pre-motor filter housing portion 208 motor housing 156. The wall of energy storage member portion 306 may form part of the outer walls of the main body 104.

It will be appreciated that the energy storage module may be mounted in a closed housing that surrounds and supports the energy storage devices, as is known in the art. In the example illustrated, energy storage member housing 320 defines one or more housing walls enclosing the energy storage members 304. As shown, the housing 320 includes a front wall 322, rear wall 324, top wall 326, and bottom wall 328. In some embodiments, one or more walls of the housing 320 may be formed integrally with the walls of the energy storage member portion 306, such as the bottom wall 328 shown in FIG. 9.

Energy storage members 304 may generate heat as they discharge, e.g. during operation of the hand vacuum cleaner 100. As shown, energy storage members 304 and/or energy storage module 302 can be positioned in direct thermal communication with the air flow path through the surface cleaning apparatus 100. Air passing through the air flow path can be used to cool the onboard energy storage members 304. This may facilitate longer operational periods for the hand vacuum cleaner 100 and may also promote a longer lifespan for the energy storage members 304.

During operation, suction motor 152 also produces heat. Thus, by positioning the energy storage members 304 upstream of suction motor 152, the air used to cool the energy storage members 304 has not yet been heated by the suction motor 152.

As exemplified in FIGS. 8-16, energy storage module 302 may be provided in thermal communication with the air flow path at various different locations of the air flow path. Accordingly, the energy storage module 302 may be positioned such that the air flow passes over and/or through the energy storage module 302. (e.g., it may surround, be positioned in or form part of part of the air flow path). Optionally the energy storage module 302 is downstream of at least one air treatment member such as cyclone chamber 160. The energy storage module may be downstream of every air treatment member that is positioned upstream of the suction motor, thereby permitting clean air to cool the energy storage module 302.

In the example illustrated, the hand vacuum cleaner 100 can be constructed with a generally linear configuration. For example, the onboard energy storage member(s) 304, suction motor 152 and air treatment member 112 can be arranged linearly within the hand vacuum cleaner 100. The longitudinal axis 484 of the cyclone chamber can extend through both the energy storage member housing 320 and suction motor housing 156. This may provide the hand vacuum cleaner 100 with a compact configuration which may make it easier to access hard to reach areas in use.

As shown, air exiting the air treatment chamber 112 through, e.g., cyclone air outlet 180 can travel rearwardly towards the onboard energy storage module 302. The treated air can travel across the surface of housing 320, to promote cooling of the energy storage members 304 enclosed therein. The air may travel across one or more sides of the energy storage module 302, e.g., one or more of the top, side, bottom side, a first lateral side 329*a* and a second lateral side 329*b* and/or through openings provided in the energy storage module 302.

The energy storage member housing portion 306 within which the energy storage module 302 is positioned can define a battery cooling airflow section 315 that extends along at least one surface of the energy storage module 302. As air flows around at least a portion of the housing 320, the air comes into contact with at least one of the walls 322, 324, 326 and 328 to promote cooling of the energy storage member housing 320 and, in turn, the energy storage members 304.

The energy storage member housing portion 306 may promote air to flow broadly across one or more external surfaces of the onboard energy storage module 302. This may promote cooling of the energy storage module 302, by promoting heat transfer across a larger portion of the surface area of housing 320. To this end, housing portion 306 may have any structure suitable for broadly distributing the air flow across energy storage module 302. For example, energy storage member housing 306 may include an upstream header 356, a downstream header 358, or both (as exemplified in FIG. 10). Headers 356 and 358 may be provided by spacing the front wall 322 and rear wall 324 of housing 320 from the exterior housing end walls 342 and 344 respectively. Headers 356 and 358 provide an air flow across the front and/or rear walls of the energy storage module 302 and enable the air flow to spread out an flow over one or more of the top, bottom and through opening provided in the energy storage module 302.

Alternately, or in addition, energy storage member housing 320 may be configured to enhance cooling of the energy storage member housing 320. For example, optionally, the housing 320 may include one or more extending fins 330. The fins 330 may promote further heat transfer between the housing 320 and air passing through the cooling section 1315. As exemplified, fins 330 may extend transverse to the direction of air flow in cooling air flow section 315 or they may extend generally parallel thereto.

Figure 10:
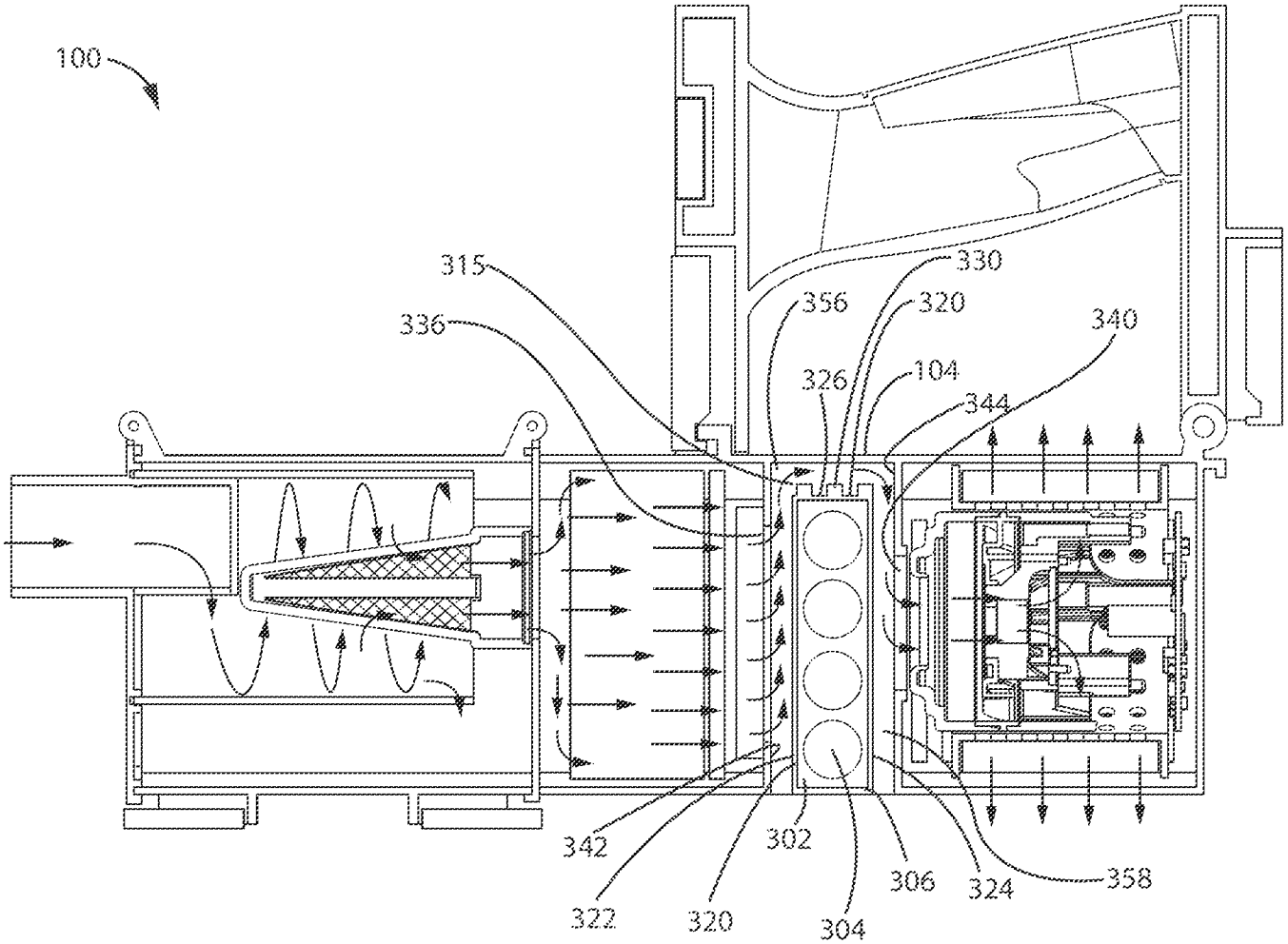
FIG. 10 is a sectional view of an example variant of the surface cleaning apparatus of FIG. 1 in accordance with an embodiment.

As shown in FIGS. 9 and 10, the housing 320 enclosing energy storage members 304 can be positioned in the air flow path, causing air to divert around the housing 320. In the examples shown in FIGS. 9 and 10, the cooling air flow path 315 extends around the top wall 326 of the housing 320.

As exemplified in FIG. 9, the battery cooling airflow section 315 can extend around the top end wall 326 of the housing 320. Air can flow over the housing 320 and rearwardly towards suction motor 152.

As exemplified in FIG. 10, upstream and downstream headers 356, 358 are provided such that air may flow over the front, top and rear walls of the energy storage module 302. The inlet 336 and/or outlet 340 of the energy storage module housing portion 306 may be generally aligned, with the interior housing 320 positioned between the inlet 336 and outlet 340. This may encourage air to flow across more of the exposed surface of housing 320, including front wall 322, top wall 326 and rear wall 324.

Figure 12:
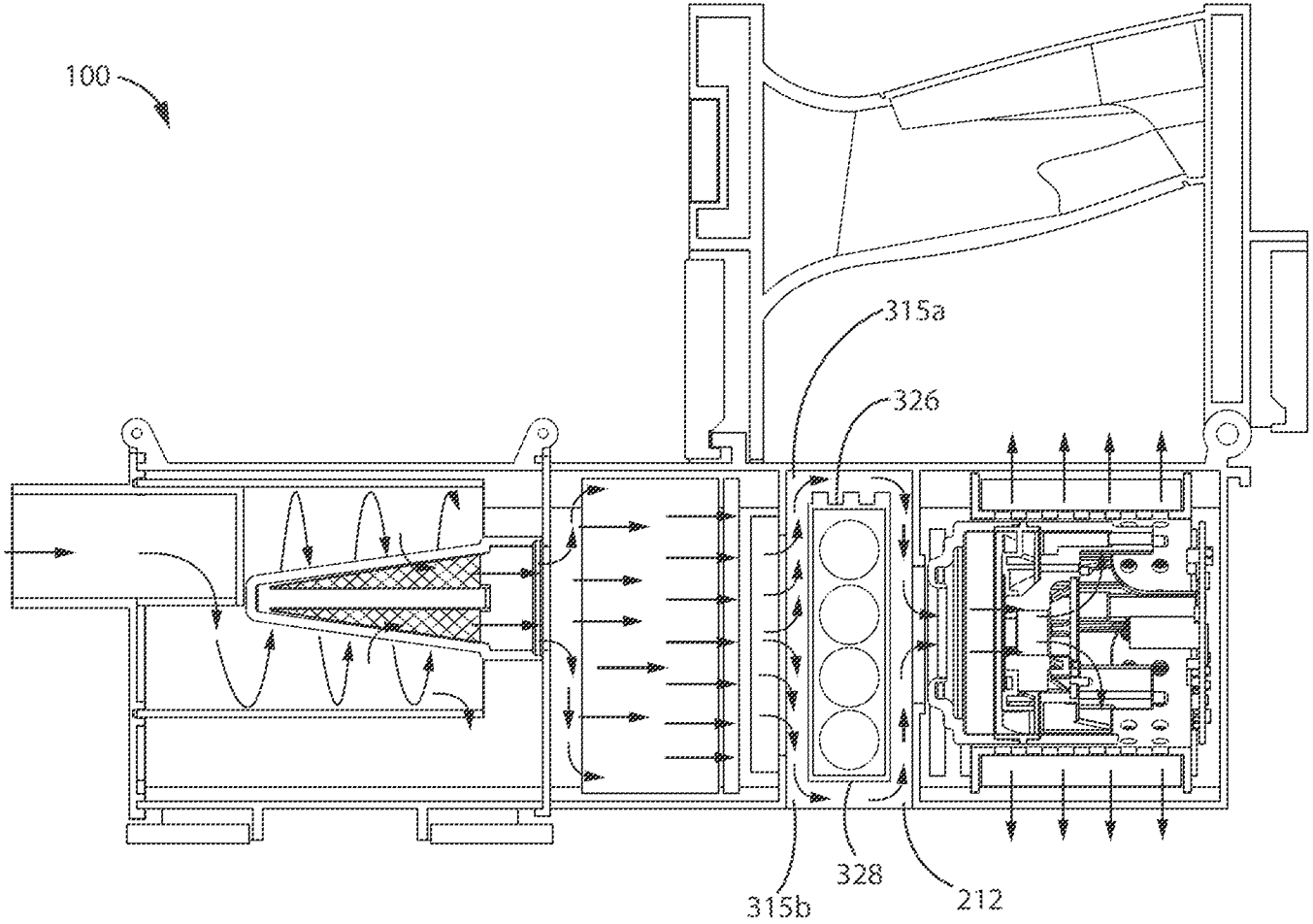
FIG. 12 is a sectional view of another example variant of the surface cleaning apparatus of FIG. 1 in accordance with an embodiment.
Figure 13:
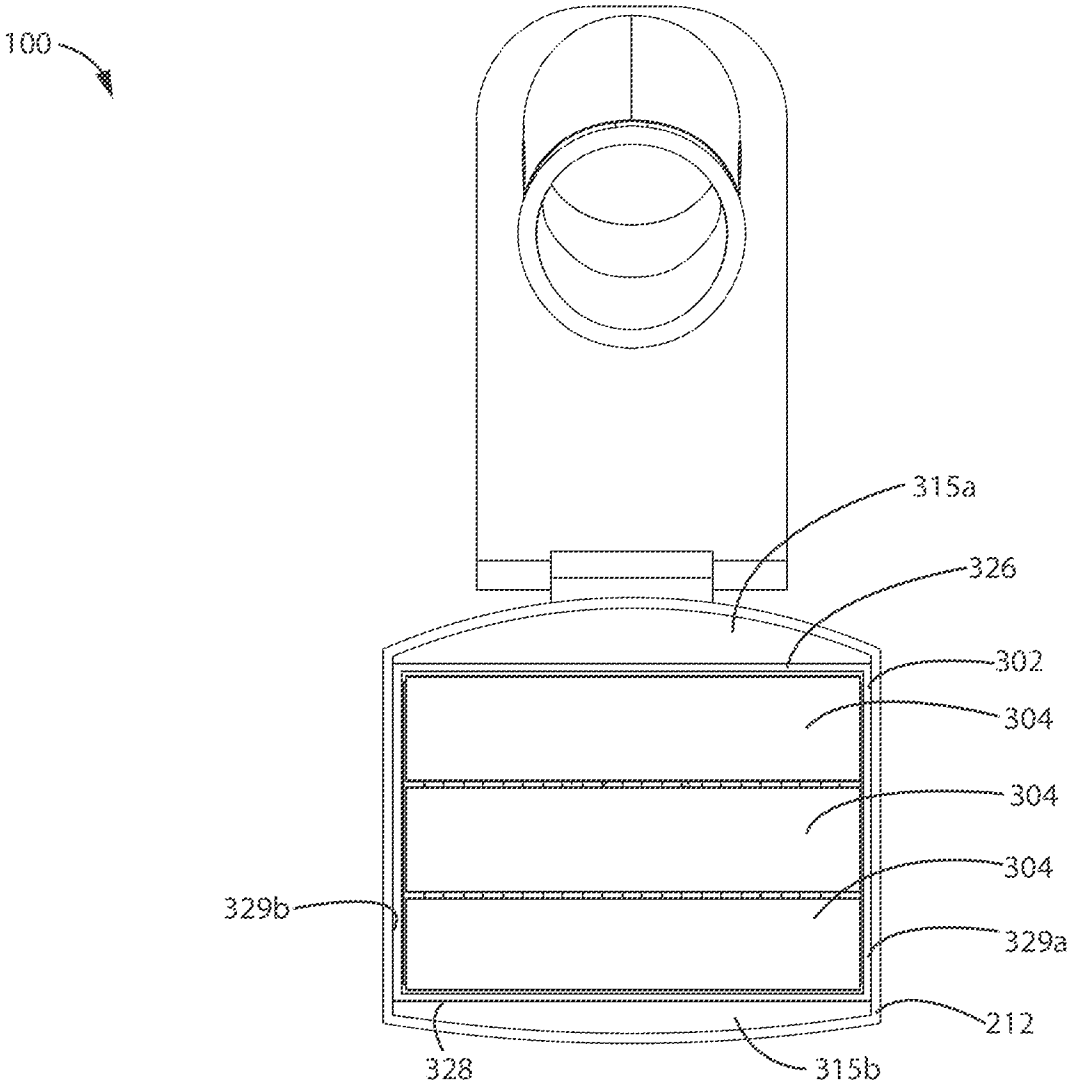
FIG. 13 is a front sectional view of the surface cleaning apparatus of FIG. 12.

Alternately, as exemplified in FIGS. 12 and 13, the energy storage member housing 306 may be configured to direct air to flow around both the bottom wall 328 and top wall 326 of the housing 320. As shown in FIG. 12, the bottom wall 328 of the internal housing 320 can be spaced apart from the exterior wall 212. Similarly, the top wall 328 may be spaced apart from the exterior wall 212 at the top of the housing 306. Accordingly, the cooling path 315 may include an upper cooling section 315*a* and a lower cooling section 315*b*. This may allow air to travel over a greater portion of the surface area of the housing 320, which may promote increased cooling of energy storage member(s) 304.

Optionally, the cross-sectional area of the battery cooling airflow section 315 in a direction transverse to a direction of flow through the battery cooling airflow section 315 is at least equal to the cross-sectional flow area of cyclone outlet 184. Accordingly, the flow of air through the battery cooling airflow section 315 may not produce an increase in the back pressure through the hand vacuum cleaner 100. For example, if the air flows across only the top of the energy storage module 302 (e.g., a cooling path section 315*a*), then the cross-sectional area of the air flow passage across the top of the energy storage module 302 in a direction transverse to a direction of flow through the air flow passage may be at least equal to the cross-sectional flow area of cyclone outlet 184. Alternately, the air flows across the top and the bottom of the energy storage module 302, then the cross-sectional area of the air flow passages across the top and across the bottom of the energy storage module 302 in a direction transverse to a direction of flow through the air flow passages may be at least equal to the cross-sectional flow area of cyclone outlet 184.

Alternately or in addition, the shape or configuration of the energy storage member or pack may be selected to conform to the shape of the portion of the wall of the air flow path that it abuts or forms part of. In the example illustrated, the main body 104 has a generally rectangular cross-sectional shape and accordingly the energy storage module 302 is also generally rectangular. In other embodiments, some of the walls of the housing 320 and/or housing 306 may be rounded.

In some embodiments, the energy storage module 302 may be shaped to permit air to flow linearly from the air treatment member 112 towards the suction motor 152. For example, the energy storage module may be shaped to surround the cooling portion 315 of the air flow pathway. The on board energy storage module or pack containing at least one on board energy storage member may be annular or substantially annular in configuration. This may facilitate linear air flow by the on-board energy storage members 304, while also promoting cooling of energy storage members 304.

Optionally, one or more pre-motor filters may be placed in the air flow path between the air treatment member and the suction motor and fan assembly.

As exemplified in FIGS. 8 and 9, main body 104 is shown including a pre-motor filter housing portion 208 that is positioned in the air flow path downstream of cyclone unit 112. In the example illustrated, the pre-motor filter housing portion 208 is positioned upstream from the onboard energy storage members 304. This may ensure that the air used to cool the energy storage members 304 is treated to remove particulate, and thus avoid clogging the air flow path around the energy storage members 304.

Pre-motor filter housing 208 may be of any construction known in the vacuum cleaner art. As exemplified, filter housing 208 may be bounded by one or more walls, which may be integral with or discrete from the main body exterior walls 212. In the example shown, the front wall of filter housing portion 208 is integral with the rear wall 196 of the air treatment member chamber 160. Alternatively, the filter housing portion 208 may be formed separately from the air treatment member 112.

Pre-motor filter housing 208 is shown including a filter housing first wall 216 axially opposite a filter housing second wall 220, and a filter housing sidewall 224 that extends in the direction of the cyclone axis of rotation 484 between the first and second walls 216 and 220. It will be appreciated that first wall 216 is optional and second wall 220 may be in the form of ribs to hold the filter in place. In some embodiments, the filter housing sidewall 224 may be defined in whole or in part by main body exterior walls 212. In the illustrated example, filter housing sidewall 224 is defined by the main body exterior walls 212, which may provide a more compact design for surface cleaning apparatus 100. Alternatively, filter housing sidewall 224 may be discrete from main body exterior walls 212, which may provide enhanced sound insulation for air passing through the pre-motor filter housing 208.

One or more filters made of or comprising a porous filter media may be positioned within the pre-motor filter housing 208 to filter particles remaining in the air flow exiting the cyclone air outlet 184, before the air flow passes by the onboard energy storage devices 304 and through suction motor and fan assembly 152. In the illustrated embodiments, pre-motor filter housing 208 contains a pre-motor filter 228. The pre-motor filter 228 may be of any suitable configuration and formed from any suitable materials. For example, the pre-motor filter 228 can be made of porous media such as foam, felt, or filter paper. In some embodiments, the pre-motor filter housing 208 may contain multiple filters, such as an upstream filter 228 and a downstream filter 229, which filters may be made of the same or different porous media. For example, a foam pre-motor filter 228 may be provided upstream of a felt pre-motor filter 229.

Pre-motor filter housing 208 may include a filter housing air inlet and a filter housing air outlet of any suitable design and arrangement within the housing 208. In the illustrated embodiment, pre-motor filter housing 208 includes a filter housing air inlet 236 formed in filter housing first wall 216, and a filter housing air outlet 240 formed in filter housing second wall 220.

Figure 15:
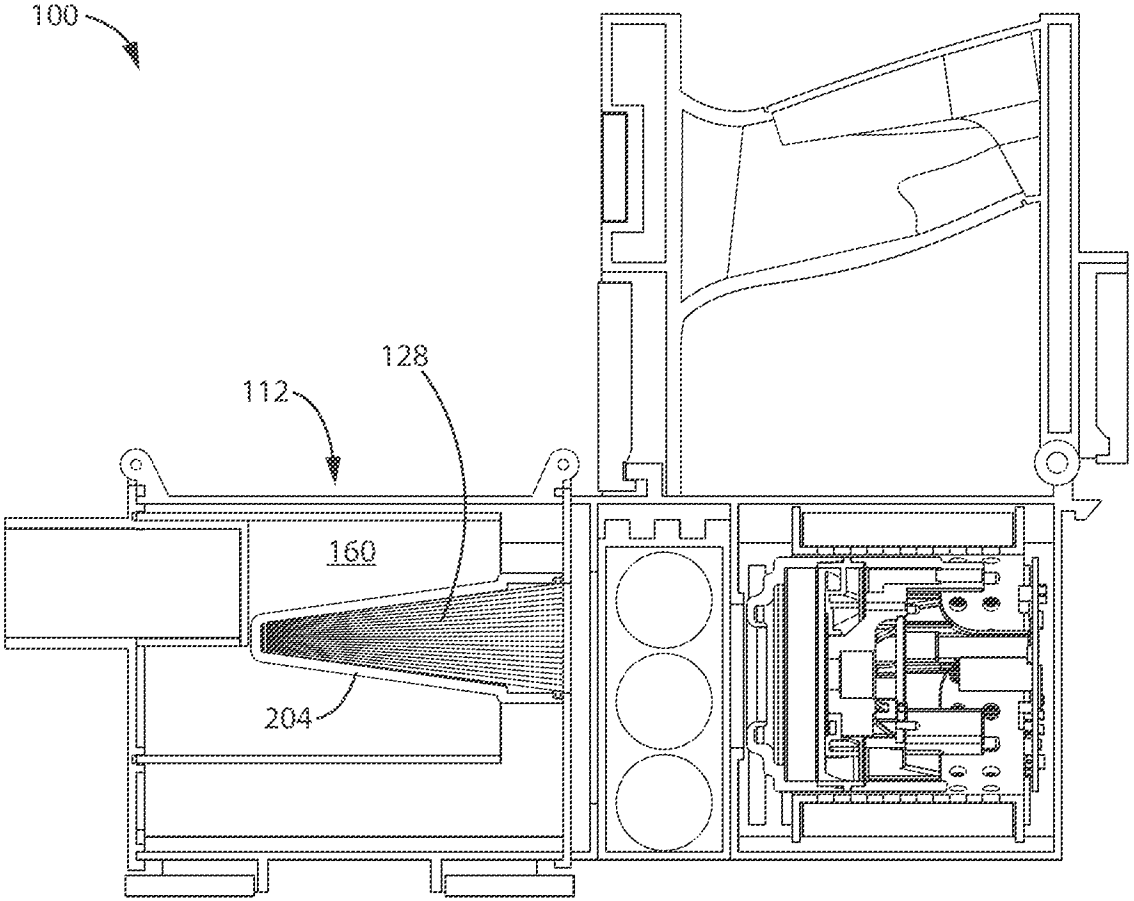
FIG. 15 is a sectional view of another example variant of the surface cleaning apparatus of FIG. 1 in accordance with an embodiment.
Figure 16:
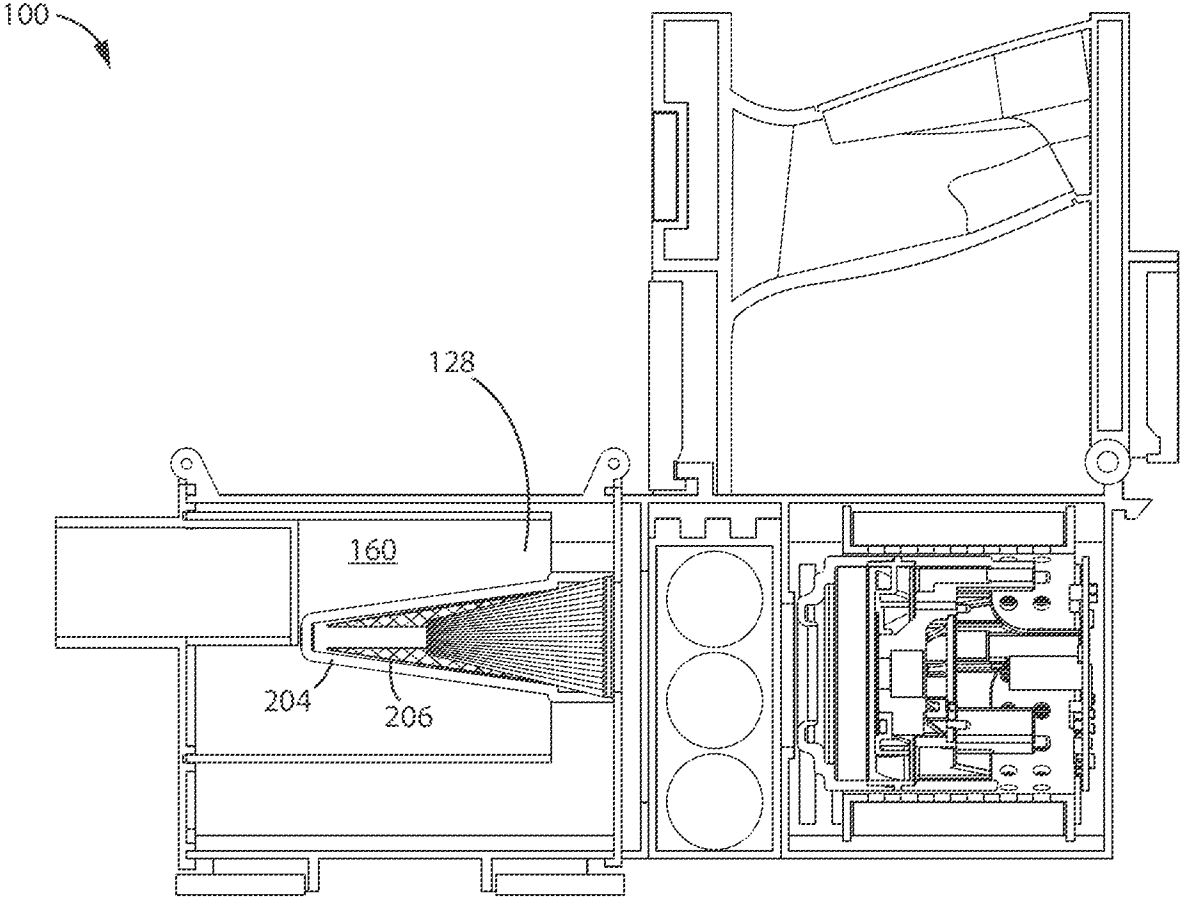
FIG. 16 is a sectional view of another example variant of the surface cleaning apparatus of FIG. 1 in accordance with an embodiment.

In some embodiments, the pre-motor filter may be at least partially or fully nested within the air treatment member. For example, FIG. 15 illustrates an example of a surface cleaning apparatus 100 in which the pre-motor filter is fully nested within the air treatment member 112. This may avoid the need for a separate pre-motor housing and reduce the overall size of hand vacuum cleaner 500.

In the example illustrated, the pre-motor filter 128 may extend into, and nest within, the interior of the rigid member 204 to filter air exiting the cyclone chamber 160. The pre-motor filter 128 can extend through the a portion of or the entire longitudinal length of the rigid member 204, e.g. as shown. Alternately, as exemplified in FIG. 16, whether the pre-motor filter is fully nested or not, the pre-motor filter 128 may extend only partially along the length of rigid member 204.

Alternately or in addition, the pre-motor filter may include a first nested filter portion and a second filter portion exterior to the air treatment member. For example, an upstream filter may be nested within the air treatment member while a downstream member is positioned exterior to the air treatment member.

In some embodiments, the hand vacuum cleaner may include a cyclonic cleaning stage positioned in the air flow path downstream from the air treatment member 112 (in which case air treatment member 112 may be considered to be a first stage air treatment member 112). The cyclonic cleaning stage can be positioned upstream from the pre-motor filter. This may allow the hand vacuum cleaner to separate additional dirt and debris from the air downstream of the air treatment member. The cyclonic cleaning stage can be arranged linearly with the other components of the hand vacuum cleaner. For example, the longitudinal axis of the air treatment member chamber can extend through the perimeter of the volume enclosing the cyclonic cleaning stage.

Figure 11:
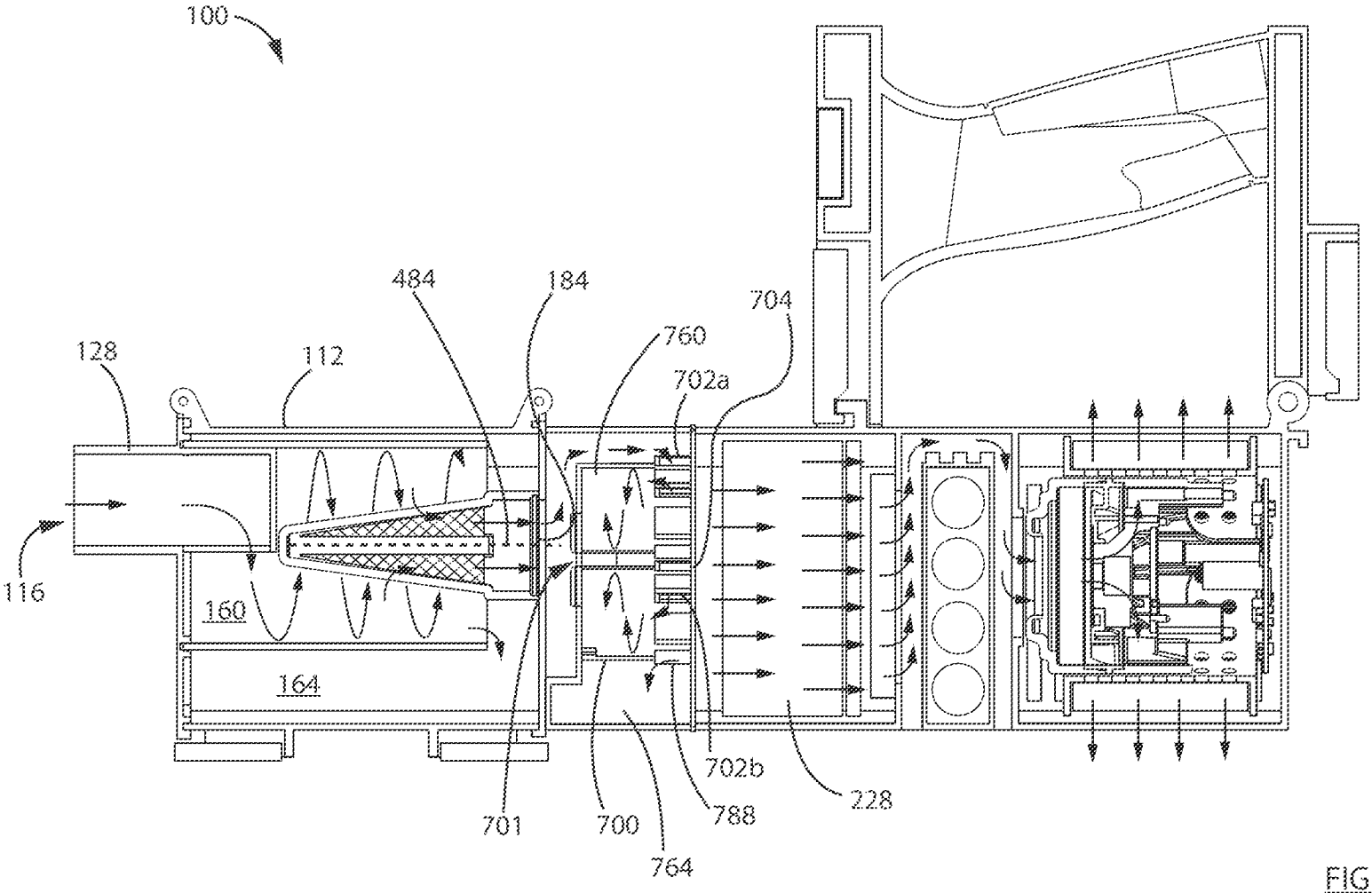
FIG. 11 is a sectional view of another example variant of the surface cleaning apparatus of FIG. 1 in accordance with an embodiment.

FIG. 11 illustrates an example of a surface cleaning apparatus 100 in accordance with an embodiment. Surface cleaning apparatus 100 is an example of a hand vacuum cleaner having a first air treatment member 112 and a second stage cyclonic cleaning stage 700 positioned in the air flow path downstream from the air treatment member 112 (which may be a first stage cyclonic cleaning stage).

As shown in the example of FIG. 11, the first cyclone unit 112 includes a cyclone chamber 160 and an external dirt collection chamber 164. However, unlike the surface cleaning apparatus 100 of FIG. 9, the cyclone air outlet 184 of the first cyclonic unit 112 is connected to an upstream air inlet 701 of the second cyclone unit 700. As shown, the longitudinal axis 484 of the cyclone unit 112 extends rearwardly through the second cyclonic cleaning stage 700.

The second cyclone unit 700 may be configured as a multi-inlet cyclone assembly. The second cyclone unit may be of any design.

As exemplified in FIG. 11, the cyclone unit 700 comprises two cyclones, each of which has an air inlet port 702*a*, 702*b*. The air inlet ports 702*a* and 702*b* may share a common airflow passage leading upstream to the upstream air inlet 701 and the first stage cyclone air outlet 184.

Air entering the second stage cyclone air inlet 701 passes through the common airflow passage, then separates into the first airflow passage 702*a* and the second airflow passage 702*b* before entering the cyclone chambers 760. Although the separate airflow passages 702 are illustrated as separate inlet ports, it should be understood that a divider may simply be provided separating the first airflow passage 702*a* and the second airflow passage 702*b*.

Each cyclone chamber 760 may have multiple cyclone air inlet passages in fluid communication with (downstream of) the inlet conduit 701, a cyclone air outlet 704, and a dirt outlet 788 that is in communication with a dirt collection chamber 274.

As exemplified, the second stage cyclone 760 may be configured as a cyclonic cleaning stage with bidirectional air flow (i.e. where the cyclone air inlet and cyclone air outlet are at the same end of the cyclone chamber). Alternatively, the second stage cyclone 760 may be a "uniflow" cyclone chamber (i.e. where the cyclone air inlets 702*a* and 702*b* and cyclone air outlet 704 are at opposite ends of the cyclone chamber). Optionally, the cyclone may be an inverted cyclone. Air passing through the second stage cyclone 760 can exit via the cyclone air outlet 704 and impinge upon a pre-motor filter 228.

Figure 14:
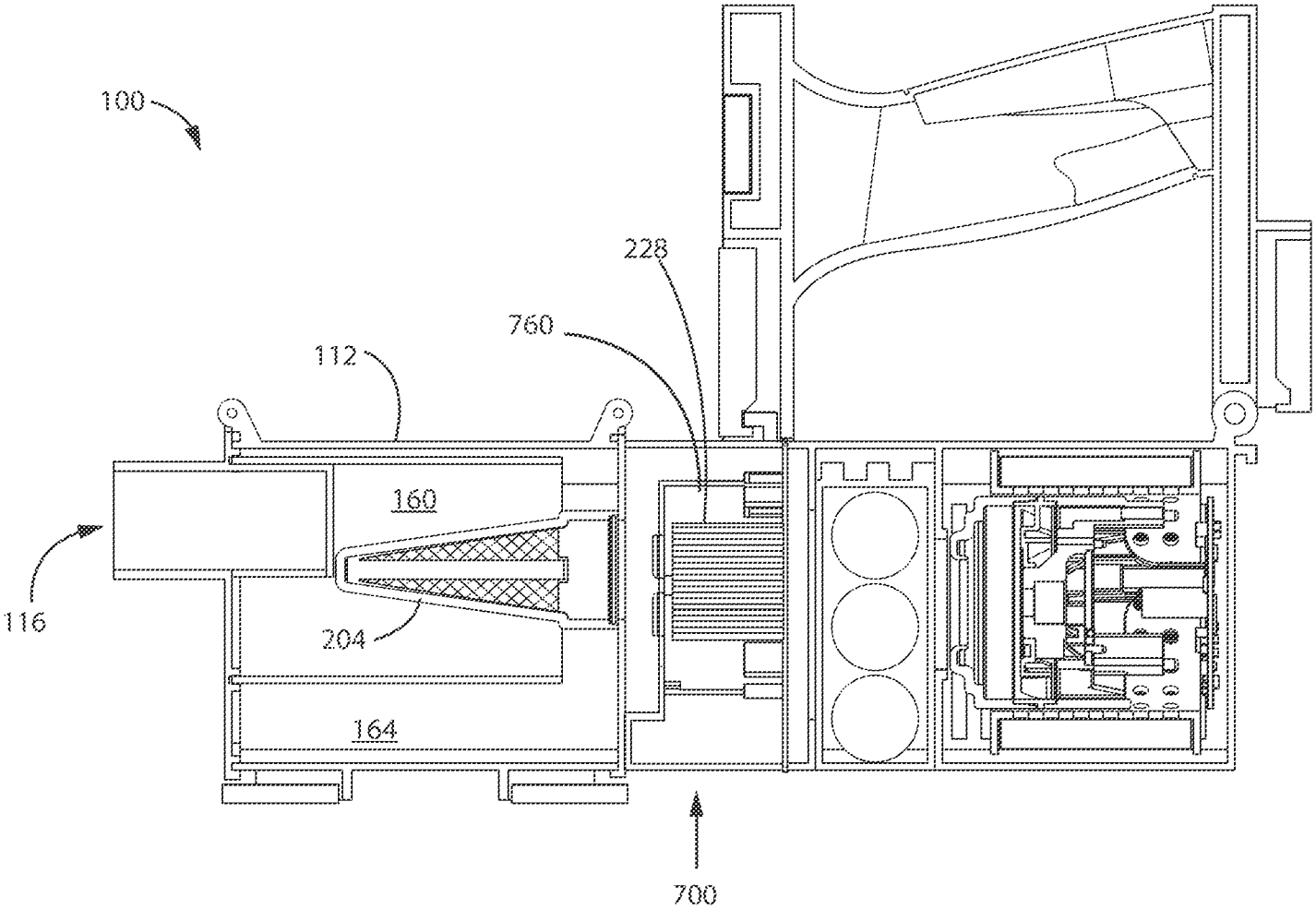
FIG. 14 is a sectional view of another example variant of the surface cleaning apparatus of FIG. 1 in accordance with an embodiment.

In some embodiments, the pre-motor filter may be at least partially nested in the second cyclonic cleaning stage 700. FIG. 14 illustrates an example of a surface cleaning apparatus 100 in accordance with an embodiment. In surface cleaning apparatus 100, the pre-motor filter 228 is nested within the secondary cyclonic cleaning stage 700. As exemplified, the pre-motor filter 228 is fully nested within a portion of the single cyclone chamber 760 (e.g. within a rigid member similar to vortex finder 204). It will be appreciated that any nesting as discussed herein with respect to the first stage air treatment member 112 may be used.

Optionally, one or more post-motor filters may be provided downstream from the suction motor and fan assembly. As exemplified, hand vacuum cleaner 100 may also include a post-motor filter 400. The post-motor filter 400 may be contained within a post-motor filter housing 402. Optionally, the post-motor filter housing 208 may be openable to allow the post-motor filter 400 to be cleaned and/or replaced.

The post-motor filter 400 can be provided in the air flow path downstream of the suction motor 152 and upstream of the clean air outlet 120. Post-motor filter 400 may be formed from any suitable physical, porous filter media and having any suitable shape, including the examples disclosed herein. In alternative embodiments, the post-motor filter may be any suitable type of filter such as one or more of a foam filter, felt filter, HEPA filter, other physical filter media, electrostatic filter, and the like.

In the example illustrated, the post-motor filter 400 is positioned surrounding the suction motor 152. The post-motor filter 400 defines an open interior within which at least a portion of the suction motor 152 is located. In alternative embodiments, the post-motor filter may be any suitable shape or configuration to filter air exiting the suction motor 152 prior to exiting through the clean air outlet 120.

In some embodiments, the handle 108 of the surface cleaning apparatus 100 may be pivotably mounted to the main body 104. This may allow the handle to be adjusted to different use positions to provide flexibility for cleaning and/or storage. As shown in FIGS. 1-7, the handle 108 can be adjusted between a first use position (shown in FIGS. 1 and 2), a second use position (shown in FIGS. 3-4) and a third use position (shown in FIGS. 4-7).

The handle 108 may include a hand grip portion 375 that extends between a bottom end 377 (e.g., the pivotally mounted end) to a top end 378 (e.g., a distal end) (see FIG. 1). As exemplified in FIG. 3, a handle axis 376 extends along the hand grip portion 375 between the bottom end 377 and top end 378. As shown, the hand grip portion 375 can be configured to define the handle axis 376 at a slightly inclined angle (e.g. about 0-10° to the vertical when in the orientation of FIG. 3), which may provide a more comfortable natural grip during use.

Figure 5:
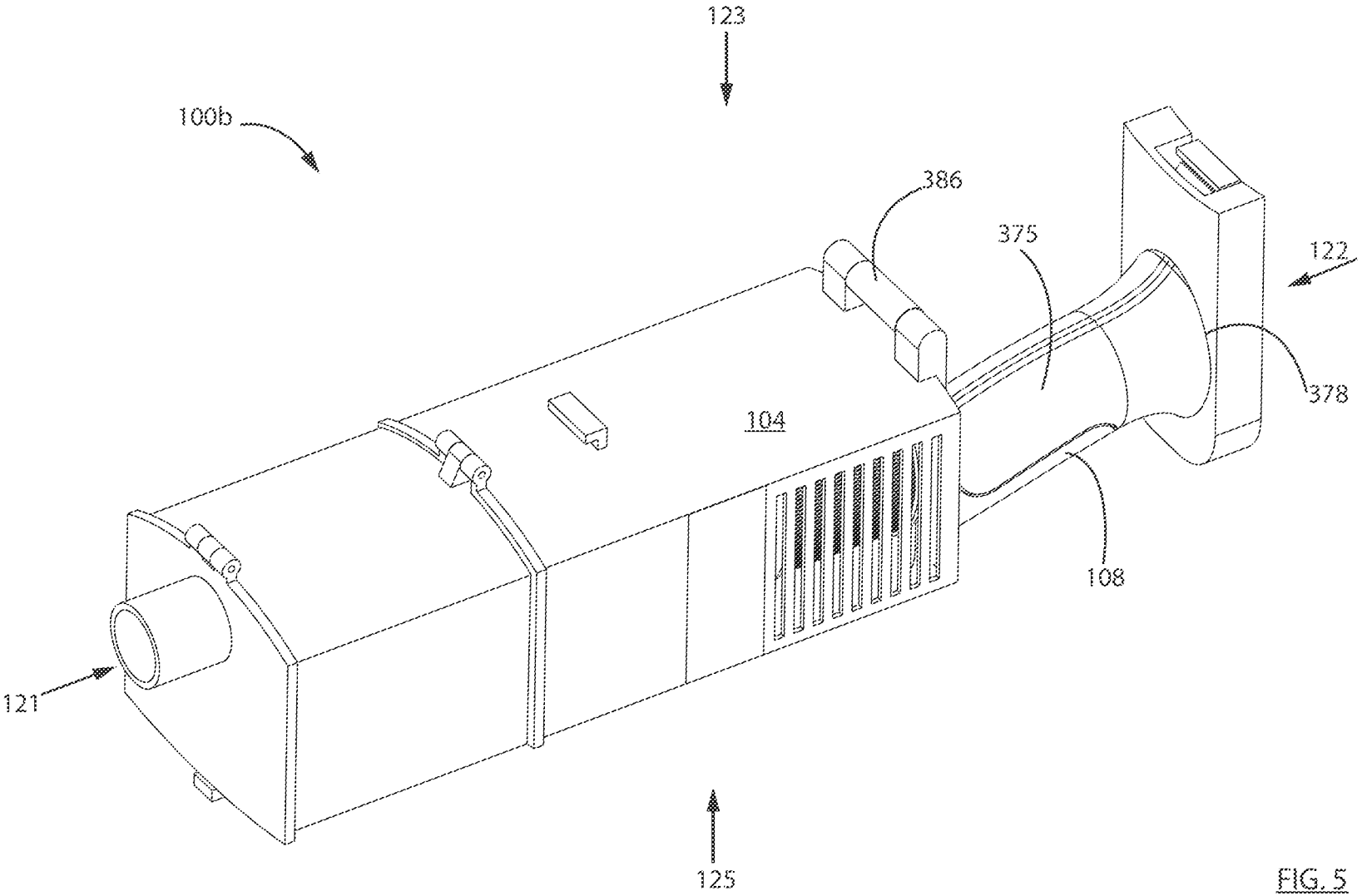
FIG. 5 is a top front perspective view of a variant of the surface cleaning apparatus of FIG. 1 with the handle in another alternate position.
Figure 6:
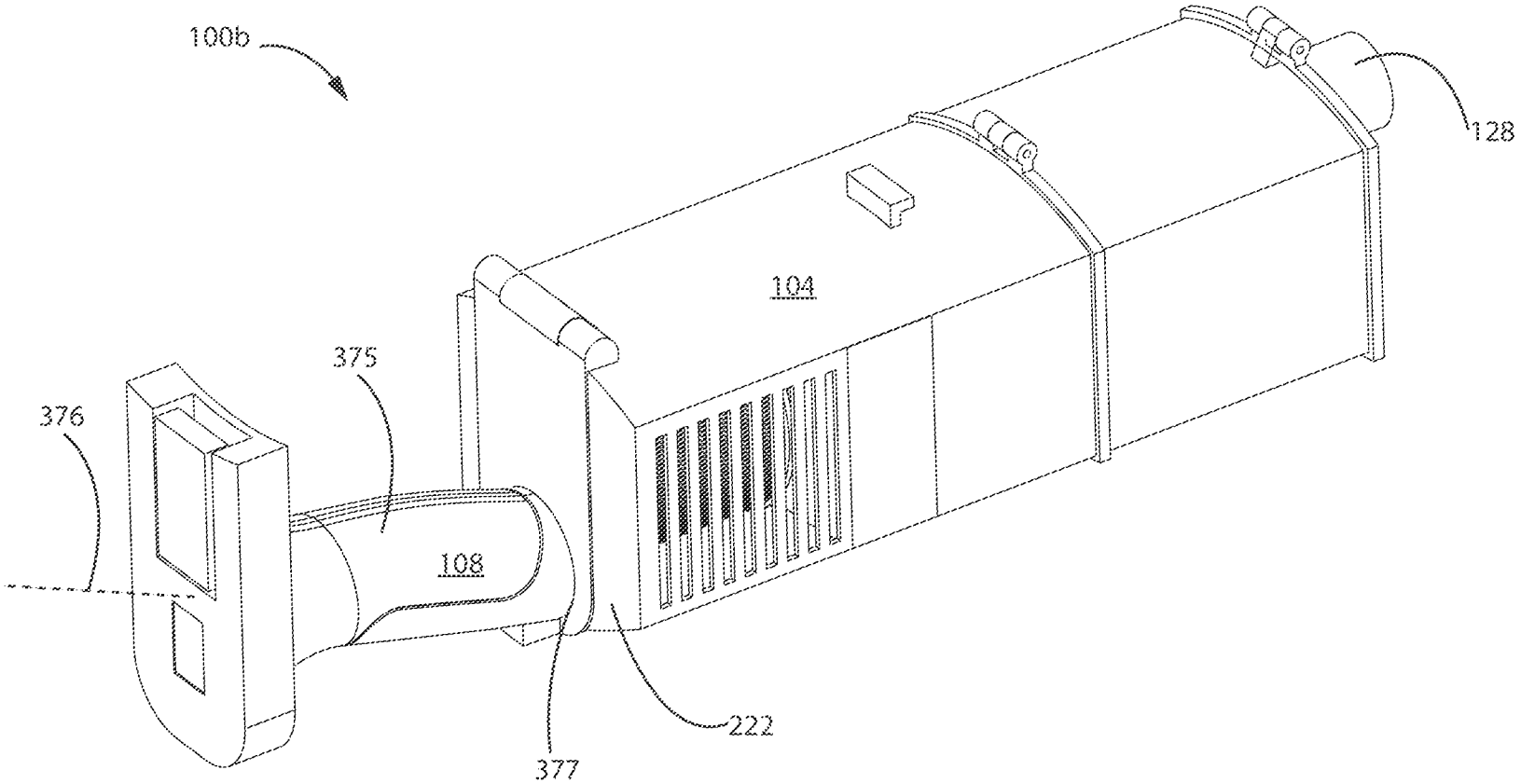
FIG. 6 is a top rear perspective view of the surface cleaning apparatus of FIG. 5.
Figure 7:
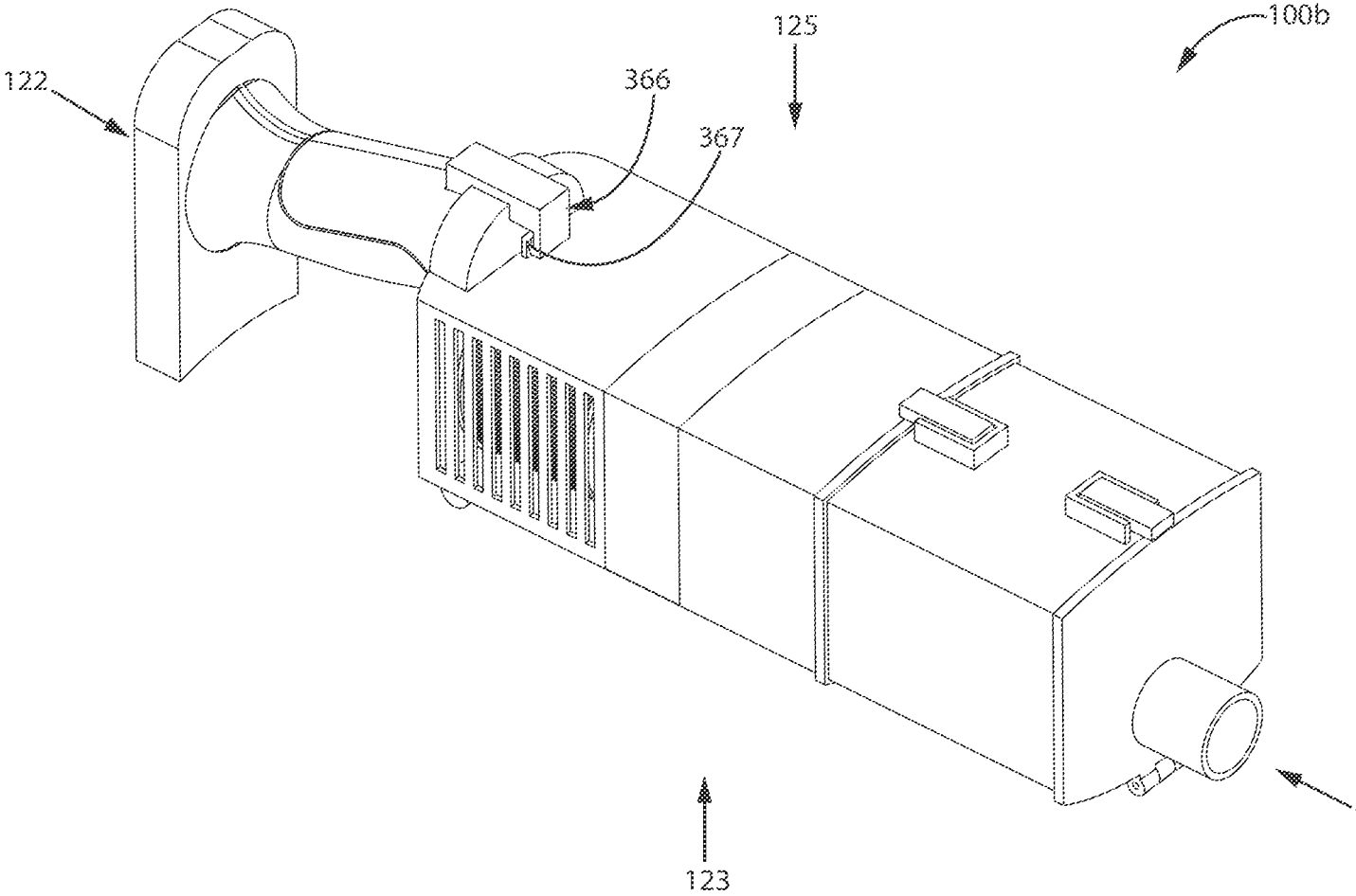
FIG. 7 is a bottom front perspective view of the surface cleaning apparatus of FIG. 5.

As exemplified, handle 108 is rotatable about a handle pivot axis 388 (see FIG. 3) between the first use position (FIG. 1), second use position (FIG. 3), and optionally a third use position (FIG. 5). It will be appreciated that handle 108 may be rotatable in any manner and direction suitable for moving handle 108 between the various use positions. In the illustrated embodiment, handle 108 is downwardly rotatable about a laterally extending (e.g. horizontal) handle pivot axis 388 located in an upper portion of the main body 104. As exemplified, the handle pivot axis 388 is transverse to (e.g. substantially perpendicular to), the handle axis 376, the inlet connector axis 364, and the cyclone axis of rotation 484.

Figure 2:
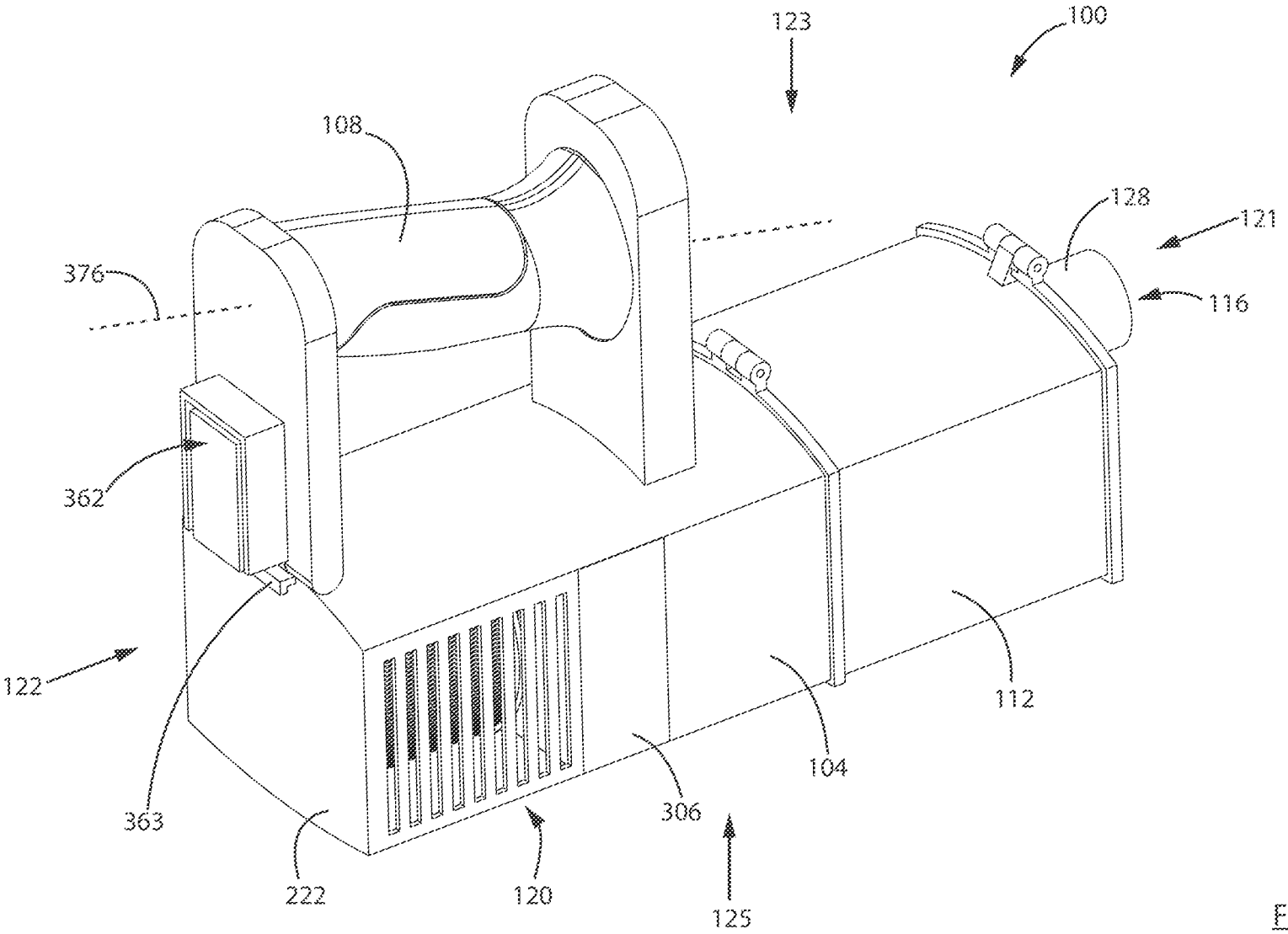
FIG. 2 is a top rear perspective view of the surface cleaning apparatus of FIG. 1.
Figure 3:
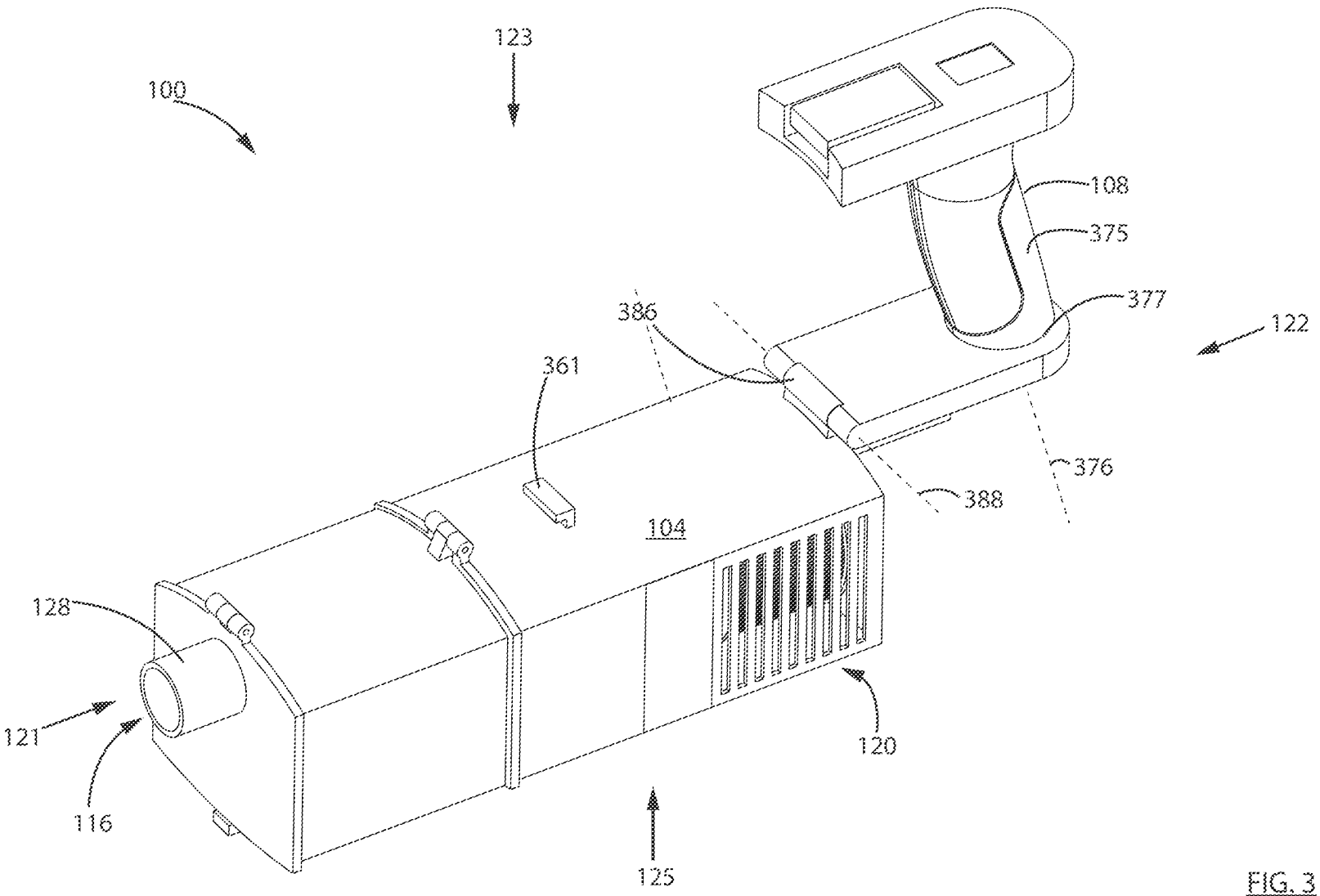
FIG. 3 is a top front perspective view of the surface cleaning apparatus of FIG. 1 with the handle in an alternate position.
Figure 4:
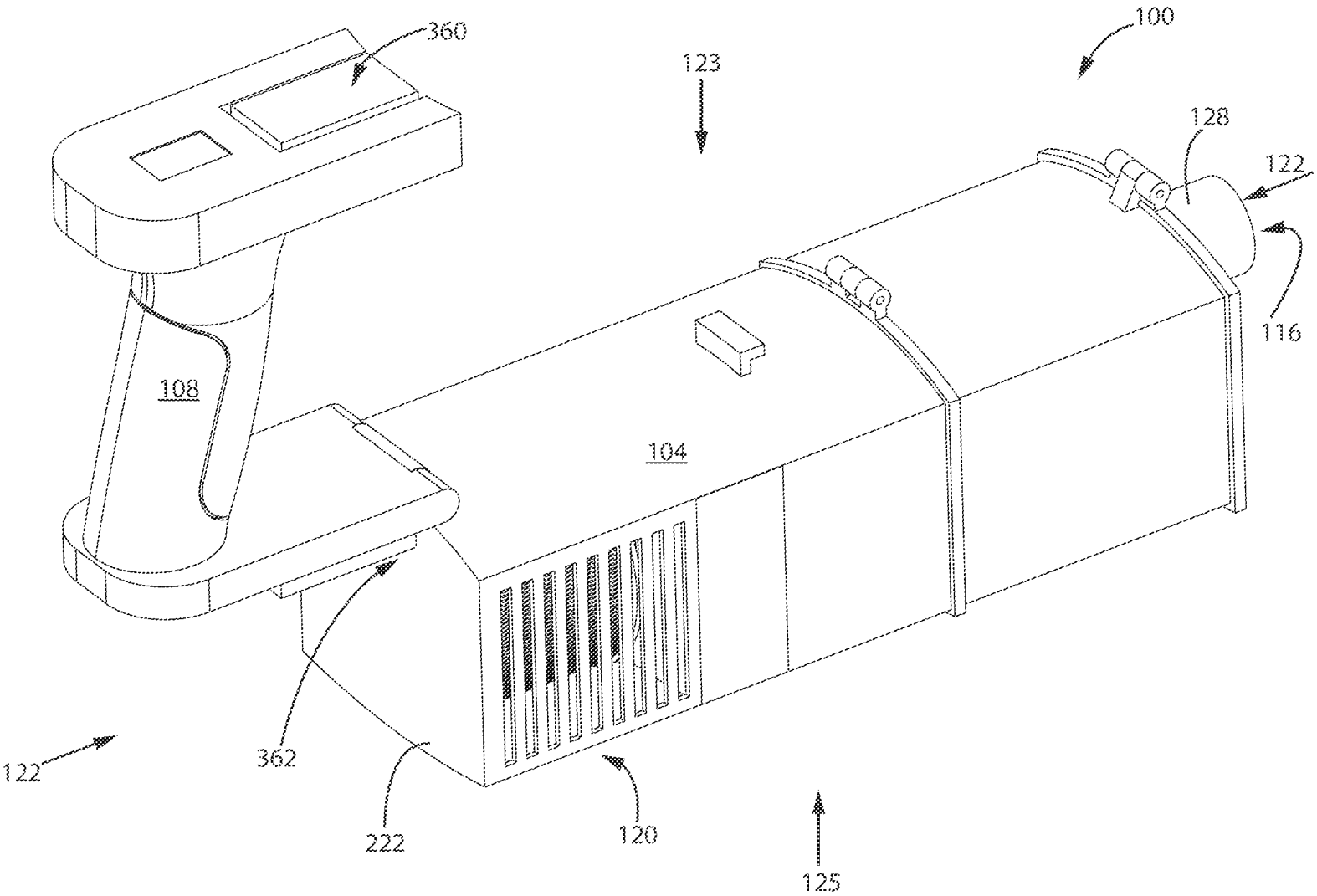
FIG. 4 is a top rear perspective view of the surface cleaning apparatus in the configuration of FIG. 3.

In the first position, the handle 108 may extend forward from the rear end 122 of the main body 104. As shown in FIGS. 1 and 2, the hand grip portion 375 can overlie at least a portion of the main body 104. This may provide an easy underhand carrying position for the hand vacuum cleaner 100, as the heavier components (e.g. the onboard energy storage module 302 and suction motor 152 can be positioned below the hand grip portion 375). In the first position, the handle axis 376 may be generally parallel to the air inlet axis 364 (e.g. within an angle of about 0-10° of the air inlet axis 364).

In the second position, the handle axis 376 can be positioned at an angle to the air inlet axis 364. For example, in the second use position the handle axis 376 may be at an angle to air inlet axis 364 of between about 10-80°, or 25-65°, or about 45°. A user may grasp the handle 108 in a generally horizontal position with the inlet end 124 of the air inlet passage 128 aiming towards a horizontal surface.

Alternately or in addition, the handle may be adjustable to a third use position with the handle axis 376 at an angle of about 80-100° or 90° to air inlet axis 364.

In the third position, the handle 108 can extend from a rear face 222 of the main body 104. The handle axis 376 may be generally parallel to the air inlet axis 364 (e.g. within an angle of about 0-10° of the air inlet axis 364). This may provide the surface cleaning apparatus 100 with greater overall length from front 121 to back 122, allowing a user to more easily clean hard to reach areas.

In the example of FIGS. 1-9, the handle 108 may be movably mounted to the main body 104 in any suitable configuration to allow the handle to be adjusted between the various use positions. For example, the handle 108 can be rotatably attached, e.g., pivotally attached to the main body 104, and/or removable altogether from the main body 104. It may be attached to a sidewall at the rear end as exemplified, it may be attached to the rear wall or it may be attached at a location forward of the rear end. Optionally, the handle is positioned and configured such that the bottom end 377 abuts the rear wall in the third position as exemplified in FIG. 6.

Handle 108 may have any construction suitable for allowing the handle 108 to rotate about the handle pivot axis 388. For example, handle 108 may be connected to main body 104 by a hinge 386 of any type known in the art.

Still referring to FIGS. 1-9, the handle 108 may be securable in each use position, and may be manually user adjustable (e.g. by hand). It will be appreciated that the handle may be securable in any position between the first and third positions. Locking the handle is a set position allows the handle 108 to remain in a desired use position while the apparatus 100 is operating, and allows the user to selectively adjust the user position of the handle 108 to the desired position when the apparatus 100 is turned off (or even while the apparatus 100 is still operating).

In the illustrated example, handle 108 includes a first release member 360 (see FIG. 1) that is user operable to release the handle 108 from being secured in the first use position to thereby permit handle 108 to move to an alternate use position, a second release member 362 (see FIG. 2) that is user operable to release the handle 108 from being secured in the second use position to thereby permit handle 108 to move to an alternate use position, and optionally a third release member 366 (see FIG. 7) that is user operable to release the handle 108 from being secured in the third use position to thereby permit handle 108 to move to an alternate use position. Each release member 360, 362, and 366 may engage a corresponding lock member 361, 363, and 367 respectively provided on the main body 104. Alternately, the release members 360, 362, and 366 may be provided on the main body and the lock members 361, 363, and 367 may be provided on the handle. Alternately a single lock unit may be used to secure the handle 108 in each of the first, second and third use positions.

Release members 360, 362 and 366 and lock members 361, 363 and 367 may be any type of lock and release actuator suitable for retaining handle 108 in each use position, and which are user releasable to permit handle 108 to move between use positions. In some embodiments, release member 360, 362 and 366 may have a manually operable actuator for moving the lock between its secured and unsecured positions.

Alternately, the handle 108 may be fixed to the main body 104. This may provide a simpler construction that may reduce the potential for failure.

Figure 17:
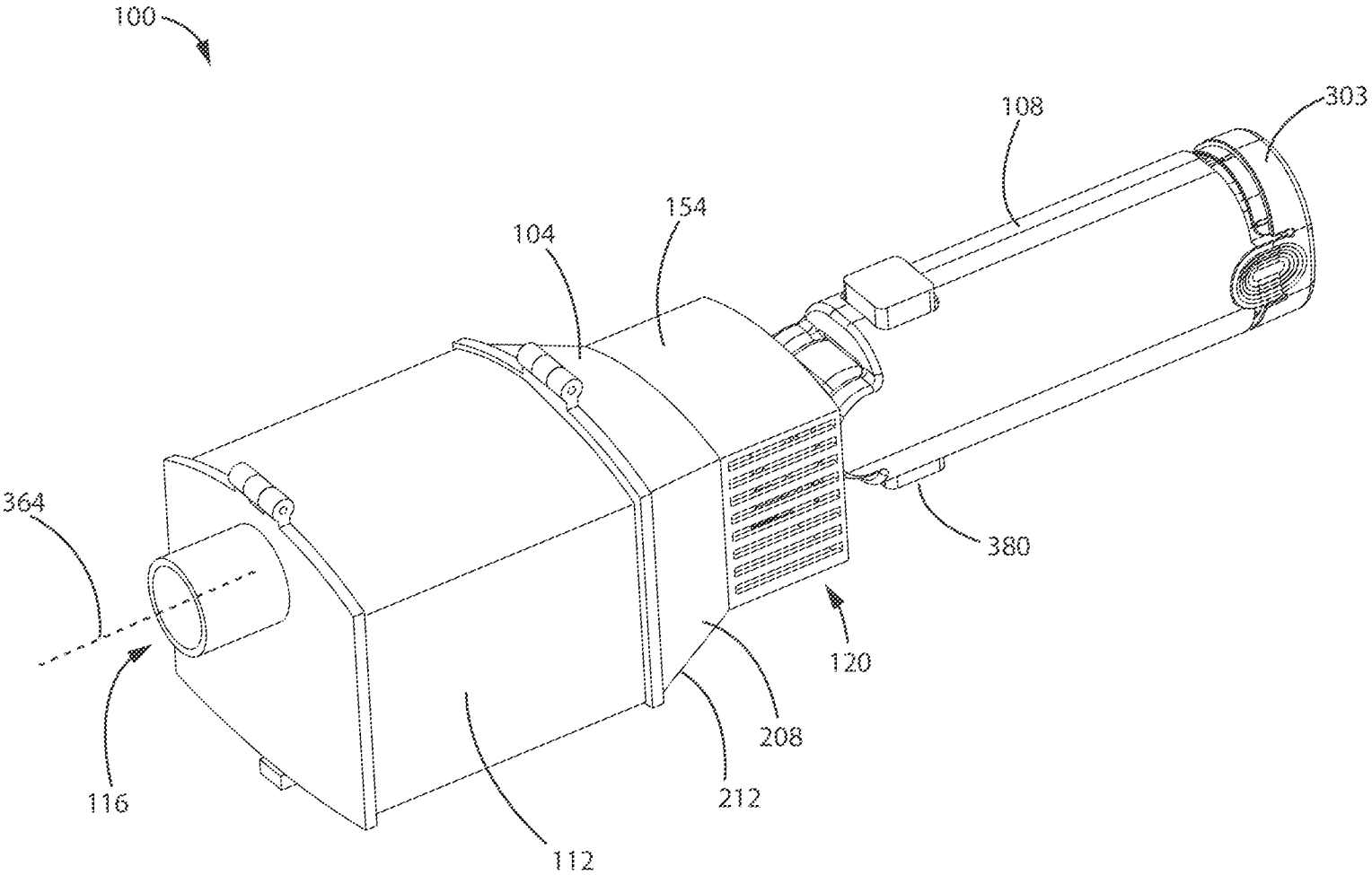
FIG. 17 is a top front perspective view of an example surface cleaning apparatus in accordance with an embodiment.
Figure 18:
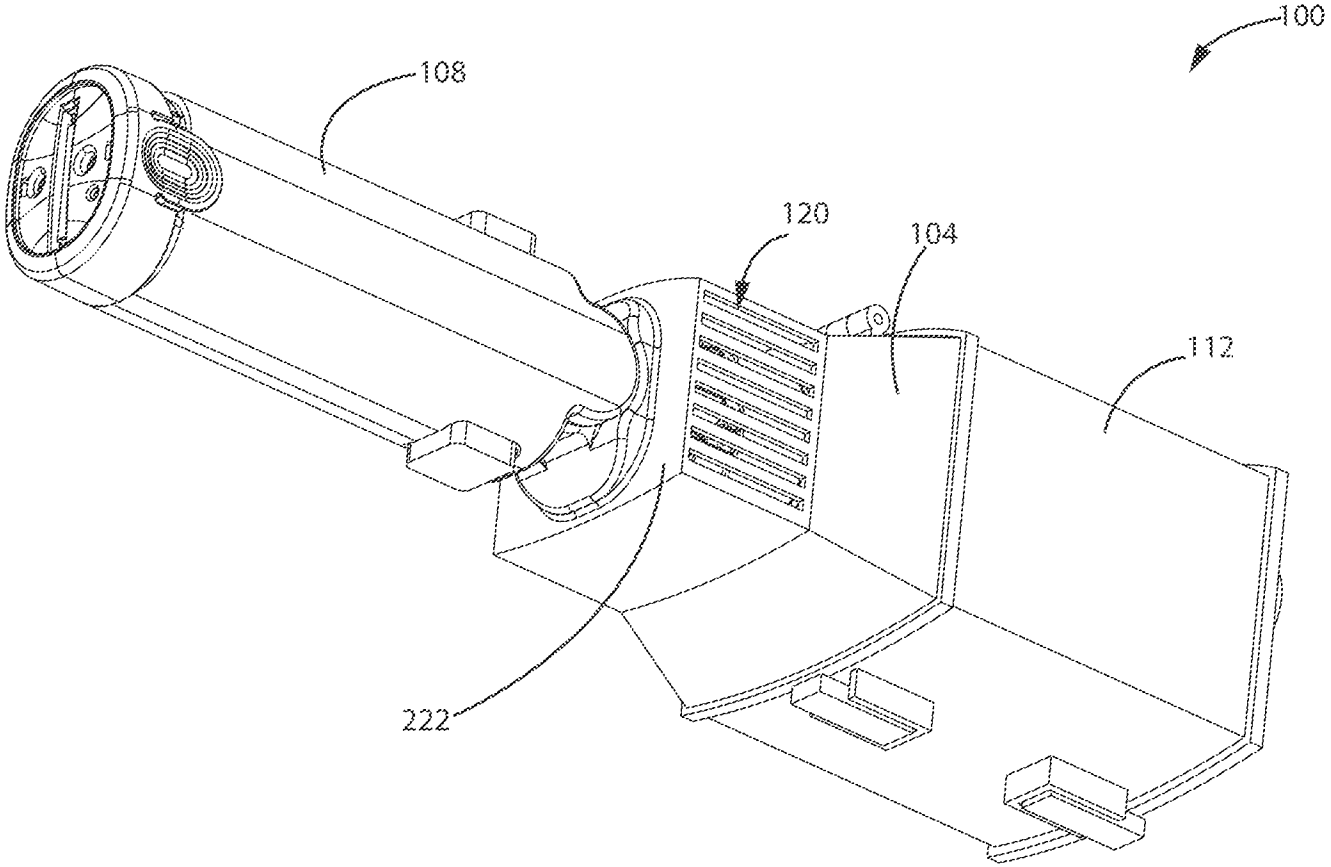
FIG. 18 is a bottom rear perspective view of the surface cleaning apparatus of FIG. 17.
Figure 19:
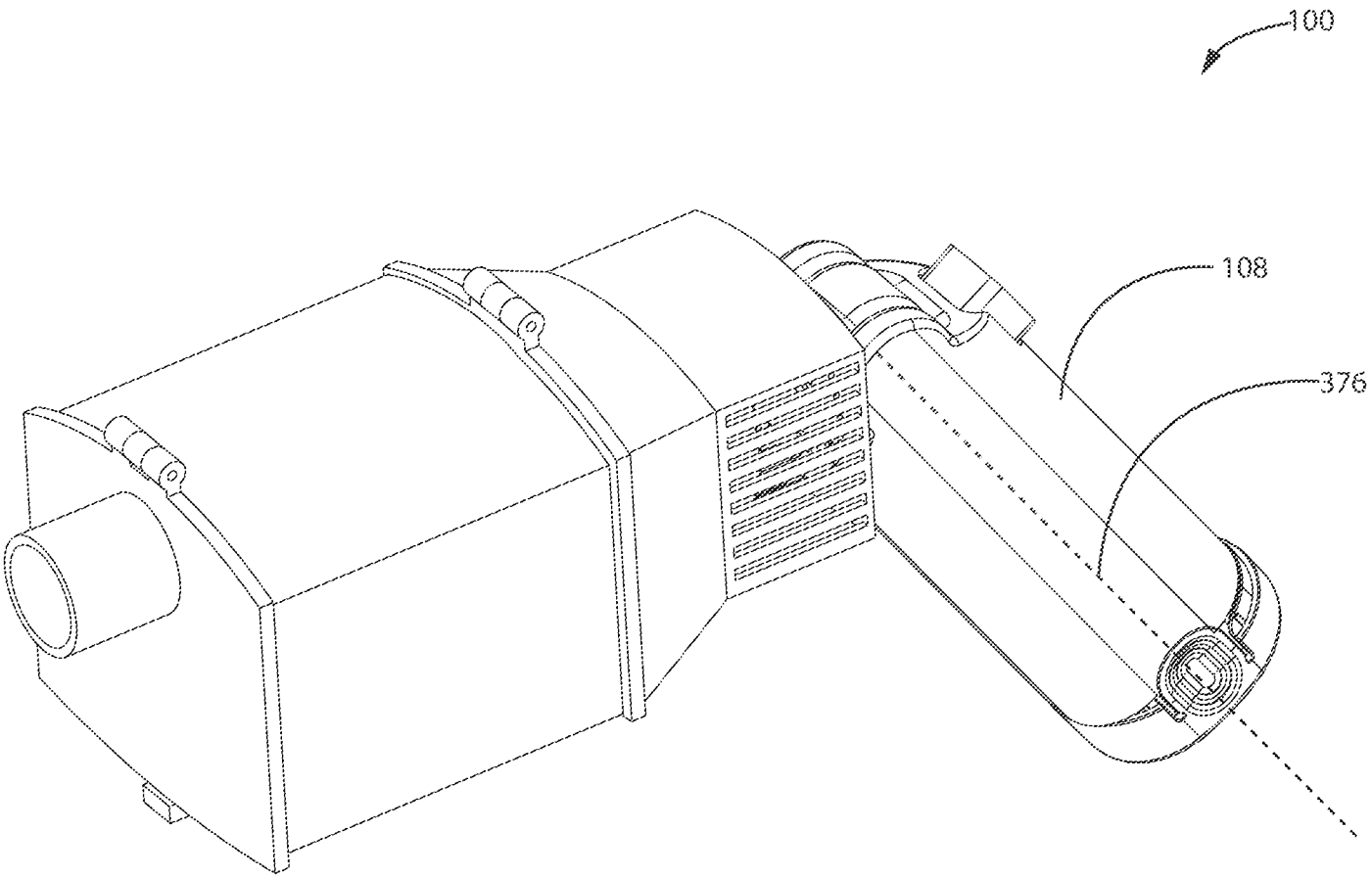
FIG. 19 is a top front perspective view of the surface cleaning apparatus of FIG. 17 with the handle adjusted to an alternate position.

As exemplified in FIG. 17, that handle may be moveably mounted to the rear wall of the main body 104. Surface cleaning apparatus 100 of FIG. 17 is generally similar to surface cleaning apparatus 100 of FIG. 1 except that the main body 104 is tapered rearward of the air treatment member 112 and a different handle 108 is provided.

As shown in FIG. 17, the pre-motor filter housing section 208 may taper between the air treatment member 112 and the suction motor housing 156. This may reduce the overall size of the surface cleaning apparatus 100.

As also exemplified, the handle 108 is rotatably connected to a rear face 222 of the main body 104. This may allow the handle to be adjusted to different use positions to provide flexibility for cleaning and/or storage. As shown in FIGS. 17-20, the handle 708 can be adjusted between a first use position (shown in FIGS. 17 and 18) and a second use position (shown in FIGS. 19 and 20), and optionally at any position therebetween.

In the first use position, the handle 108 can extend from the rear face 222 of the main body 104. The handle axis 376 may be generally parallel to the air inlet axis 364 (e.g. within an angle of about 0-10° of the air inlet axis 364). This may provide the surface cleaning apparatus 100 with greater overall length from front to back, allowing a user to more easily clean hard to reach areas.

In the second use position, the handle 108 can extend rearwardly and downwardly from the rear face 222 of the main body 104. Accordingly, a portion of the handle 108 can be located below the lower end of the hand vacuum cleaner 100. This may provide a user with a comfortable, and easy to support grip when cleaning high areas or overhead.

Optionally, the handle 108 may house electronic control circuitry for the surface cleaning apparatus 100. Additionally or alternatively, the handle 108 may also house an energy storage member for the surface cleaning apparatus. This may provide a balanced weight distribution and facilitate handling of surface cleaning apparatus 100, as the weight of the onboard energy storage member may balance the weight suction motor for a user using handle 108. This may also facilitate a reduction in overall length of the surface cleaning apparatus 100.

Alternately, the energy storage member may be stored external to the handle. For example, the energy storage member may be contained within the main body 104 as exemplified in FIGS. 8 and 9.

Returning to FIG. 17, the handle 108 may include a removable base 303. The base 303 may be openable (e.g., rotatable openable or detachable) from the handle 108 to provide access to an energy storage module contained therein. This may allow the batteries to be removed for charging and/or replacement. In some cases, the energy storage module may be removed as an enclosed container. Alternately, the batteries may be separately removable.

The handle 108 can also include a power button 380. The power button 380 may be used to activate and deactivate operation of the suction motor and fan assembly 152.

In some embodiments, the power button 380 may be used to activate and deactivate an optional output display on the surface cleaning apparatus.

The power button 380 can be manually operated by a user. The power button 380 can be positioned at a location on the handle 108 so that a user can activate the power button 380 while supporting the handle 108 with the same hand. For example, the power button 380 may be positioned on the bottom side of the handle 108 so that a user can operate the power button 380 with their index finger while supporting the handle 108 with the remaining three fingers on the same hand.

In some embodiments, surface cleaning apparatus 100 could be removably mountable on a base so as to form, for example, an upright vacuum cleaner, a canister vacuum cleaner, a stick vac, a wet-dry vacuum cleaner and the like. Power can be supplied to the surface cleaning apparatus 100 by an electrical cord (not shown) that can be connected to a standard wall electrical outlet. Alternatively, or in addition, the power source for the surface cleaning apparatus can be an onboard energy storage device, including, for example, one or more batteries.

Figure 20:
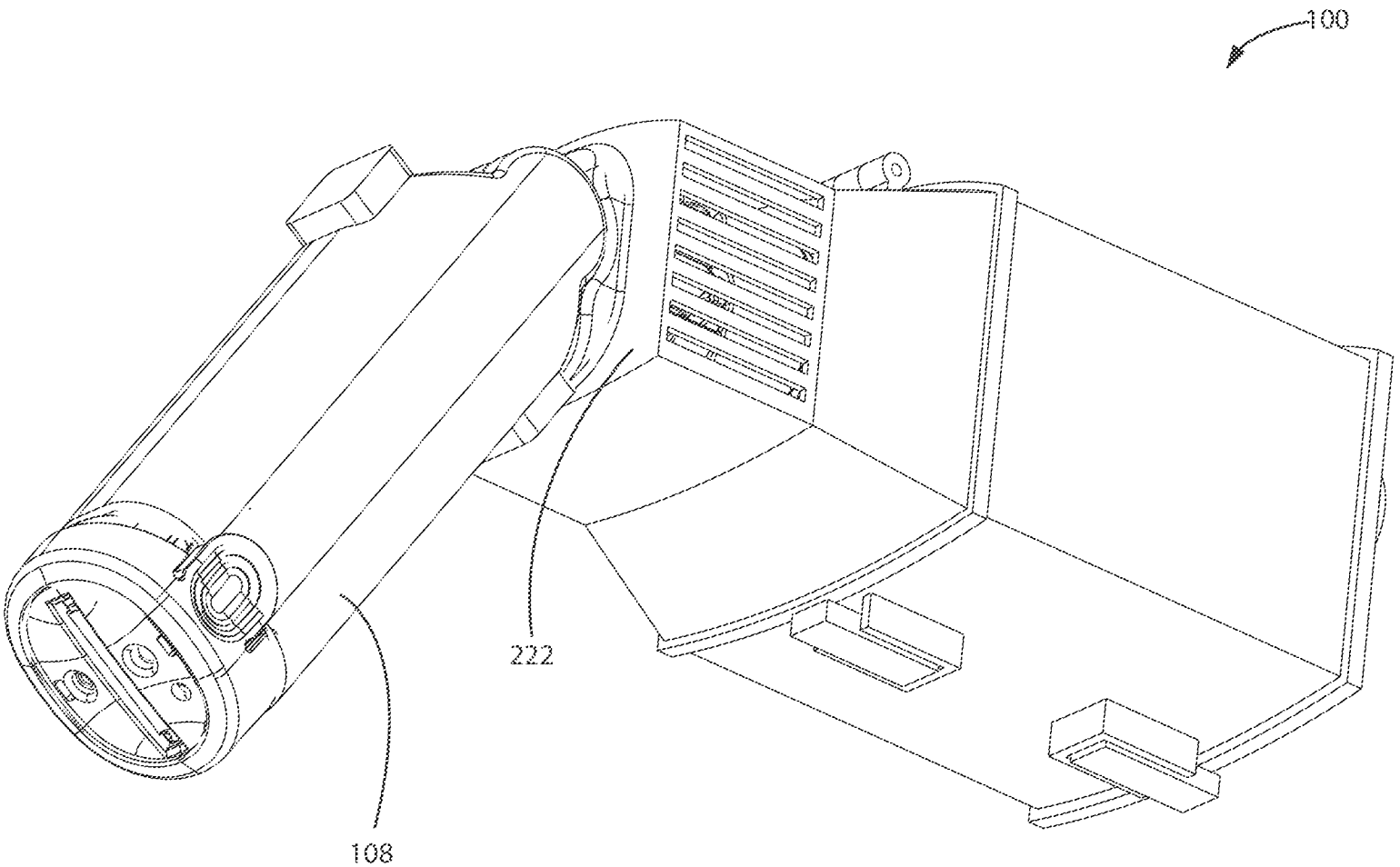
FIG. 20 is a bottom rear perspective view of the surface cleaning apparatus of FIG. 19 with the handle adjusted to the alternate position shown in FIG. 19.
Figure 21:
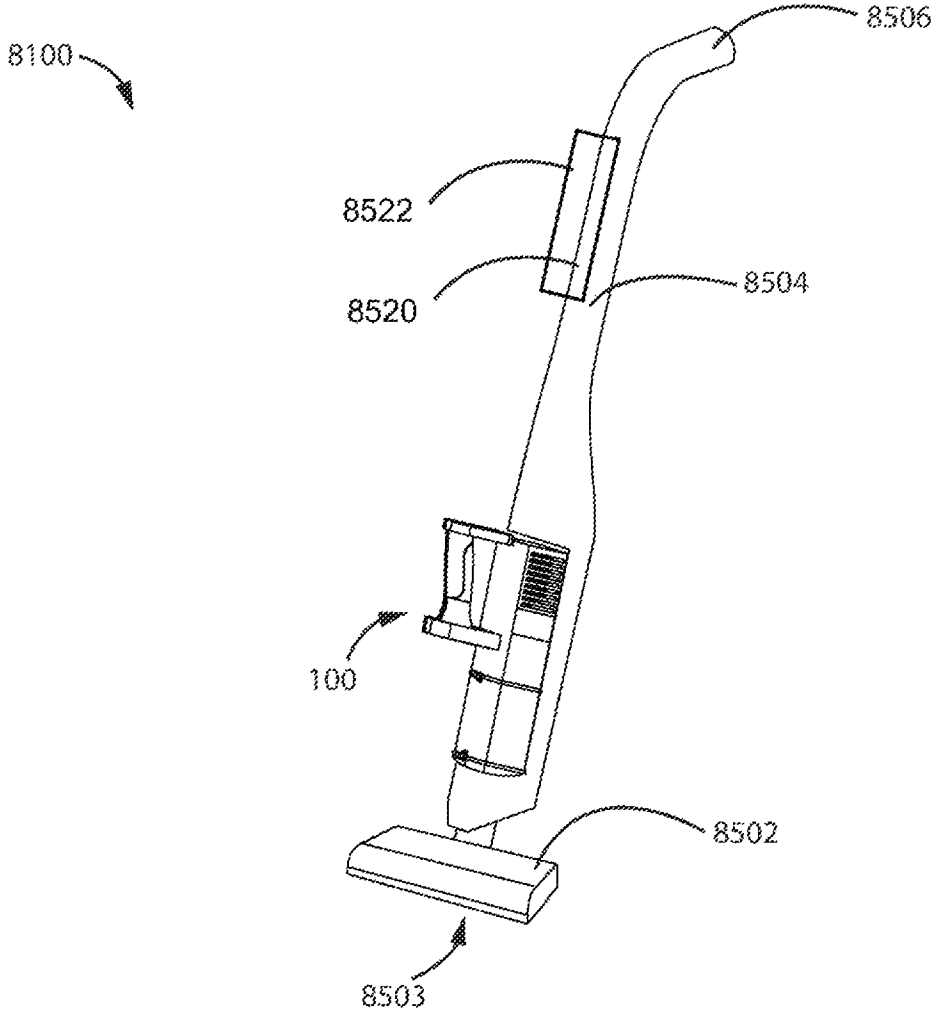
FIG. 21 is a perspective view of an example surface cleaning apparatus in accordance with an embodiment; and, FIG. 22 is a perspective view of the surface cleaning apparatus of FIG. 21 with a removable surface cleaning apparatus detached therefrom.
Figure 22:
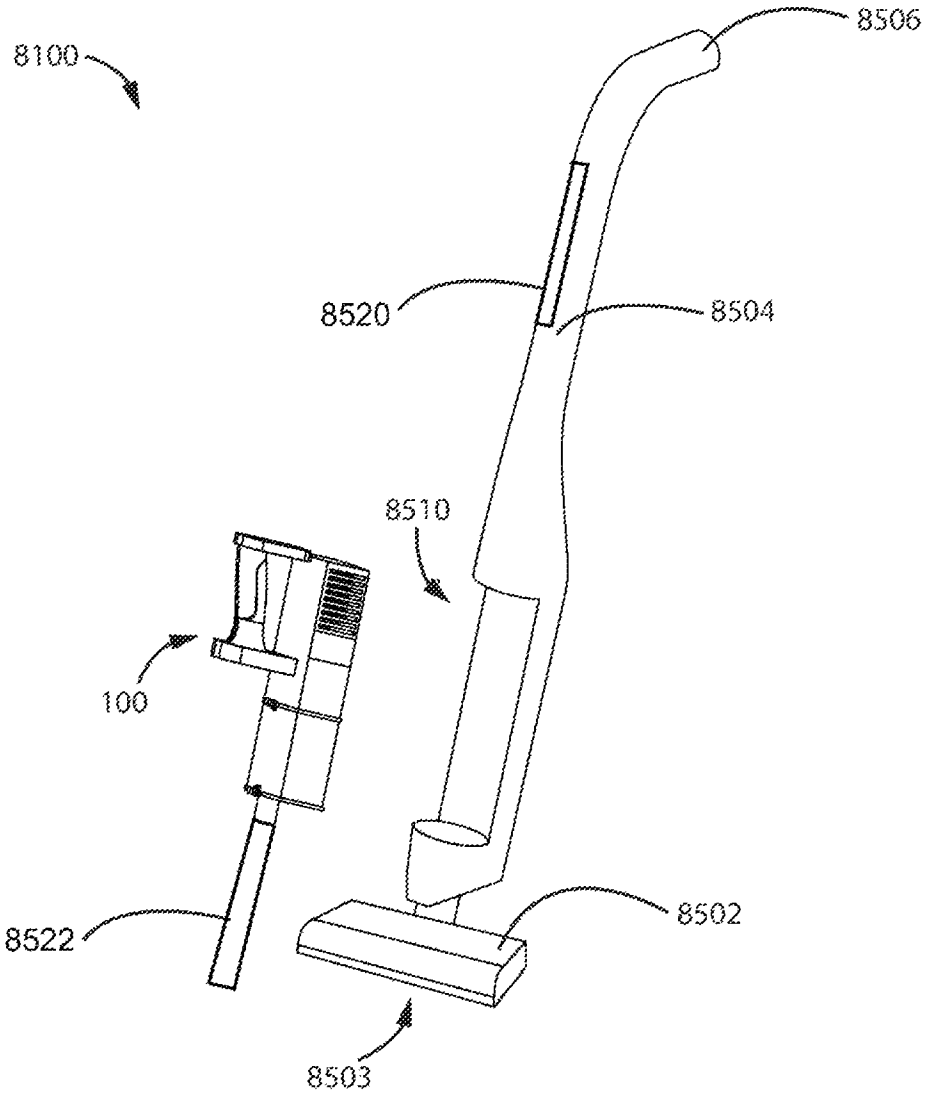

FIGS. 20 and 21 illustrate an example of a surface cleaning apparatus 8100. Surface cleaning apparatus 8100 includes a surface cleaning head 8502 with a dirty air inlet 8503. An upper section 8504 is movably mounted to the surface cleaning head 8502. The upper section 8504 can be adjusted (with respect to the surface cleaning head 8502) between an upright storage position and a rearwardly inclined use position. A driving handle 8506 can be provided at the upper end of the upper section 8504. A user can control the driving handle 8506 to maneuver the upper section 8504 and surface cleaning head 8502 during use.

As shown in FIGS. 20 and 21, the upper section 8504 can include a recess 8510. The recess 8510 can be configured to removably receive a hand vacuum cleaner, such as the example hand vacuum cleaner 100 described herein above. This may provide a user with flexibility to clean floors and larger areas with surface cleaning apparatus 8100, while also providing a hand vacuum cleaner 100 to access difficult to reach areas, and surfaces that cannot be cleaned with surface cleaning head 8502. This may also provide a convenient charging configuration for hand vacuum cleaner 100 while the surface cleaning apparatus 8100 is being used. For example, upper section 8504 or surface cleaning head 8502 may include a charging circuit usable to charge an onboard energy storage module 302 provided in the hand vacuum cleaner 100.

As noted above, the inlet end 124 of the surface cleaning apparatus 100 can be connected or directly connected to the downstream end of any suitable accessory tool such as a rigid air flow conduit (e.g. wand, crevice tool, mini brush or the like) for example. In some embodiments, the upper section 8504 can include an accessory tool holding member that is operable to removably store an accessory tool usable with the surface cleaning apparatus 100. The accessory tool may be removably connected with the inlet end 124 when both surface cleaning apparatus 100 and the tool are removed from the upper section 8504.

Optionally, the hand vacuum cleaner may include an accessory power coupler adjacent to the inlet end 124. The accessory power coupler may be inter-engageable with compatible electrical connectors on an accessory tool in order to provide an electrical connection between e.g. a power source of the hand vacuum 100 and a motor or other electrical device of an accessory tool (e.g. a powered brush roller, a light source, and the like).

While the above description provides examples of the embodiments, it will be appreciated that some features and/or functions of the described embodiments are susceptible to modification without departing from the spirit and principles of operation of the described embodiments. Accordingly, what has been described above has been intended to be illustrative of the invention and non-limiting and it will be understood by persons skilled in the art that other variants and modifications may be made without departing from the scope of the invention as defined in the claims appended hereto. The scope of the claims should not be limited by the preferred embodiments and examples, but should be given the broadest interpretation consistent with the description as a whole.

I claim:

1. A hand vacuum cleaner having a front end, a rear end, an upper end and a lower end, the hand vacuum cleaner comprising:

(a) an air flow path extending from a nozzle comprising a dirty air inlet to a clean air outlet;

(b) an air treatment chamber positioned in the air flow path downstream of the dirty air inlet, the air treatment chamber having a longitudinal axis extending centrally through the air treatment chamber between a front end of the air treatment chamber and a rear end of the air treatment chamber;

(c) a motor and fan assembly producing an air flow through the air flow path, the motor having an axis of rotation; and, (d) a single driving handle, which, in use, is used to move the nozzle over a surface to be cleaned, wherein the single driving handle is moveable between a first use position and a second use position wherein the single driving handle has a hand grip portion having a handle axis that extends through the hand grip portion from a first hand grip portion end to a second hand grip portion end, when the single driving handle is in the first use position, the handle axis extends generally in a forward/rearward direction and the hand grip portion is rearward of the hand vacuum cleaner, and when the single driving handle is in the second use position, the hand grip portion of the single driving handle extends in a generally transverse direction to the longitudinal axis, and wherein the nozzle is fixed in position with respect to the motor and fan assembly at all times when the hand vacuum cleaner is in use, and wherein an inlet conduit extends from the dirty air inlet provided at a front end of the inlet conduit to an air inlet of the air treatment chamber provided at a rear end of the inlet conduit, and wherein, when the single driving handle is in the first use position, an axis that is parallel with the longitudinal axis extends through the inlet conduit from the front end of the inlet conduit to the rear end of the inlet conduit, the air treatment chamber, the first hand grip portion end and the second hand grip portion end.

2. The hand vacuum cleaner of claim 1 further comprising a single lock securing the single driving handle in the first use position and the second use position.

3. The hand vacuum cleaner of claim 1 wherein, when the single driving handle is in the first use position, the hand grip portion of the single driving handle extends in the same direction as the motor axis of rotation.

4. The hand vacuum cleaner of claim 3 wherein, when the single driving handle is in the first use position, the hand grip portion of the single driving handle is located between upper and lower ends of the hand vacuum cleaner.

5. The hand vacuum cleaner of claim 3 further comprising a main body that houses the motor and fan assembly and the single driving handle is mounted to a rearward facing wall of the main body.

6. The hand vacuum cleaner of claim 1 wherein the hand grip portion of the single driving handle houses an on board energy storage member.

7. The hand vacuum cleaner of claim 6 wherein the on board energy storage member is removably positionable in the hand grip portion of the single driving handle.

8. The hand vacuum cleaner of claim 1 wherein the single driving handle further comprises a power button.

9. The hand vacuum cleaner of claim 1 further comprising a main body that houses the motor and fan assembly and the single driving handle is mounted to a rearward facing wall of the main body.

10. The hand vacuum cleaner of claim 1 further comprising a first lock securing the single driving handle in the first use position and a second lock securing the single driving handle in the second use position.

11. The hand vacuum cleaner of claim 10 wherein a portion of the first lock is located at the first handle end and a portion of the second lock is provided at the second handle end.

12. The hand vacuum cleaner of claim 10 wherein, when the single driving handle is in a third use position, an enclosed finger grip area is provided by the handle and the main body.

13. The hand vacuum cleaner of claim 1 further comprising a main body that houses the motor and fan assembly and the first handle end is located abutting a rearward facing wall of the main body when the single driving handle is in the first use position.

14. The hand vacuum cleaner of claim 13 wherein, when the single driving handle is moved to the second use position, the first handle end is rotated away from the rearward facing wall.

15. The hand vacuum cleaner of claim 1 further comprising a main body that houses the motor and fan assembly and a lock securing the single driving handle in the first use position, the lock comprising first and second inter-engaging members, the first inter-engaging member provided on the handle and the second inter-engaging member provided on the main body.

16. The hand vacuum cleaner of claim 1 further comprising a main body that houses the motor and fan assembly, wherein, in the first use position, a lock secures the handle to the main body in the first use position.

17. A hand vacuum cleaner comprising:

(a) an air flow path extending from a nozzle comprising a dirty air inlet to a clean air outlet;

(b) a main body housing a motor and fan assembly producing an air flow through the air flow path, the motor having an axis of rotation;

(c) an air treatment chamber positioned in the air flow path downstream of the dirty air inlet, the air treatment chamber having a longitudinal axis extending centrally through the air treatment chamber between a front end of the air treatment chamber and a rear end of the air treatment chamber; and, (d) a single driving handle, which, in use, is used to move the nozzle over a surface to be cleaned, wherein the single driving handle is rotatably mounted to a rearward facing wall of the main body, the single driving handle has a hand grip portion having a handle axis that extends through the hand grip portion from a first hand grip portion end, which is rotatably mounted to the rearward facing wall by a rotatable mount mounted at the rearward facing wall, to a second hand grip portion end and, in a first use position, the handle axis extends in a forward/rearward direction and is located rearward of the rearward facing wall of the main body and, in a second use position, the handle axis extends generally transverse to the forward/rearward direction, and wherein the nozzle is fixed in position with respect to the motor and fan assembly at all times when the hand vacuum cleaner is in use, and wherein, in the first use position, an axis that is parallel with the longitudinal axis intersects the nozzle and the first hand grip portion end, and wherein the rotatable mount is directly fixed to the main body in all operation configurations of the hand vacuum cleaner.

18. The hand vacuum cleaner of claim 17 wherein in the first use position, the axis that extends in a common direction with the longitudinal axis also intersects the air treatment chamber.

19. A hand vacuum cleaner comprising:

(a) an air flow path extending from a nozzle comprising a dirty air inlet to a clean air outlet;

(b) a main body housing a motor and fan assembly producing an air flow through the air flow path, the motor having an axis of rotation;

(c) an air treatment chamber positioned in the air flow path downstream of the dirty air inlet, the air treatment chamber having a longitudinal axis extending centrally through the air treatment chamber between a front end of the air treatment chamber and a rear end of the air treatment chamber;

(d) a single driving handle, which, in use, is used to move the nozzle over a surface to be cleaned, wherein the single driving handle is rotatably mounted to a rearward facing wall of the main body, the single driving handle has a hand grip portion having a handle axis that extends through the hand grip portion from a first hand grip portion end, which is rotatably mounted to the rearward facing wall by a rotatable mount mounted at the rearward facing wall, to a second hand grip portion end and, in a first use position, the handle axis extends in a forward/rearward direction and is located rearward of the rearward facing wall of the main body and, in a second use position, the handle axis extends generally transverse to the forward/rearward direction, and (e) an energy storage member; and, wherein the nozzle is fixed in position with respect to the motor and fan assembly at all times when the hand vacuum cleaner is in use, and wherein, in the first use position, an axis that is parallel with the longitudinal axis intersects the air treatment chamber, the energy storage member and the first hand grip portion end, and wherein the rotatable mount is directly fixed to the main body in all operation configurations of the hand vacuum cleaner.

20. The hand vacuum cleaner of claim 19 wherein in the first use position, the axis that extends in a common direction with the longitudinal axis also intersects the second hand grip portion end.

* * * * *